US008266851B2

(12) United States Patent
Campbell et al.

(10) Patent No.: US 8,266,851 B2
(45) Date of Patent: Sep. 18, 2012

(54) MULLION SYSTEM

(75) Inventors: Colin D. Campbell, Daleville, VA (US); James M. Bowling, Ferrum, VA (US)

(73) Assignee: Ply Gem Industries, Inc., Cary, NC (US)

( * ) Notice: Subject to any disclaimer, the term of this patent is extended or adjusted under 35 U.S.C. 154(b) by 213 days.

(21) Appl. No.: 12/364,954

(22) Filed: Feb. 3, 2009

(65) Prior Publication Data

US 2010/0192488 A1 Aug. 5, 2010

(51) Int. Cl.

| | |
|---|---|
| ***E06B 3/04*** | (2006.01) |
| ***E06B 3/00*** | (2006.01) |
| ***E06B 1/04*** | (2006.01) |
| *E06B 7/14* | (2006.01) |

(52) U.S. Cl. ..... 52/204.5; 52/209; 52/656.5; 52/656.6; 52/656.9; 49/504; 403/187

(58) Field of Classification Search ..... 52/209, 52/204.5, 204.1, 206, 213, 302.1, 282.1, 52/656.2, 656.5, 656.6, 302.6, 302.3, 235, 52/656.9; 49/365, 504; 403/187, 188, 230
See application file for complete search history.

(56) References Cited

U.S. PATENT DOCUMENTS

| | | | | |
|---|---|---|---|---|
| 4,150,518 | A | 4/1979 | Truesdell et al. | |
| 4,292,771 | A | 10/1981 | Ellis | |
| 4,428,171 | A * | 1/1984 | Harbin | 52/204.593 |
| 5,086,596 | A | 2/1992 | Schlyper et al. | |
| 5,481,839 | A * | 1/1996 | Lang et al. | 52/235 |
| 5,622,017 | A * | 4/1997 | Lynn et al. | 52/209 |
| 5,644,878 | A * | 7/1997 | Wehrmann | 52/287.1 |
| 5,832,681 | A | 11/1998 | Johnson | |
| 5,890,319 | A | 4/1999 | Haeck et al. | |
| 6,125,606 | A * | 10/2000 | Larsson | 52/836 |
| 6,131,338 | A | 10/2000 | Haeck et al. | |
| 6,205,724 | B1 | 3/2001 | Garling et al. | |
| 6,360,498 | B1 | 3/2002 | Westphal | |
| 6,427,387 | B1 | 8/2002 | Hunt | |
| 6,523,311 | B2 | 2/2003 | Edger | |
| 6,598,361 | B2 | 7/2003 | Ting | |
| 6,662,512 | B2 | 12/2003 | Westphal | |
| 7,080,488 | B2 * | 7/2006 | Hocker et al. | 52/235 |
| 7,637,058 | B2 * | 12/2009 | Lai | 49/425 |
| 2003/0217523 | A1 * | 11/2003 | Budzinski | 52/204.5 |
| 2005/0166495 | A1 * | 8/2005 | Cho et al. | 52/204.5 |

(Continued)

FOREIGN PATENT DOCUMENTS

WO WO 2006120384 A1 * 11/2006

(Continued)

OTHER PUBLICATIONS

Kolbe & IKolbe Millwork "V707 T Impact Mullion Elevations and General Notes" May 15, 2007, 4 pages.

(Continued)

*Primary Examiner* — Basil Katcheves
*Assistant Examiner* — Rodney Mintz
(74) *Attorney, Agent, or Firm* — Lathrop & Gage LLP

(57) ABSTRACT

A mullion system includes a universal reinforcement key, that joins window frame members and when anchored in a window frame opening or against other window frame joining members, contributes to bearing the load on the window frame unit. The system also includes a mull strip member with end caps designed to weep moisture away from and out of the window frame unit.

8 Claims, 25 Drawing Sheets

U.S. PATENT DOCUMENTS

| | | | | |
|---|---|---|---|---|
| 2006/0029463 | A1 * | 2/2006 | Schultz et al. | 403/187 |
| 2006/0080917 | A1 * | 4/2006 | Hall et al. | 52/235 |
| 2007/0240373 | A1 * | 10/2007 | Yu | 52/213 |
| 2008/0010919 | A1 * | 1/2008 | Tufts et al. | 52/204.591 |
| 2008/0216424 | A1 * | 9/2008 | Westphal et al. | 52/204.5 |
| 2009/0000225 | A1 * | 1/2009 | Ito et al. | 52/204.5 |
| 2009/0094923 | A1 * | 4/2009 | Weir et al. | 52/506.01 |

FOREIGN PATENT DOCUMENTS

WO WO 2008013423 A1 * 1/2008

OTHER PUBLICATIONS

Brannen Millwork "Brannen MW Clipped Mullion Non Impact" Feb. 13, 2008, 2 pages.
Paradigm Window Solutions "⅜"x3 9/16"' Muillion Horizontal Elevation, Notes and Design Pressure Chart" May 12, 2008, 4 pages.
Atrium Companies, Inc. "Vertical and Horizontal Mullions Elevations" Jul. 21, 2008, 9 pages.
Pella Corporation "Thermaster Series 10 Single Hunt & Picture Window Vertical Non-Impact Mullion" Sep. 10, 2008, 4 pages.
YKK AP America "YOW-225H Series Windows Stacking Mullions—4427" Dec. 15, 2008, 4 pages.
CertainTeed, "New Castle XT Windows Stage IV" 2005, 2 pages.
CertainTeed, "Somerton II and New Castle II Windows" 2007, 4 pages.
WALZ "Engineering Evaluation Report—Report No. WE-2008-158" Sep. 11, 2008, 3 pages.
Mi Windows and Doors "M-2248 FIN Vertical Installation" No date provided, but applicant states the date before is before Feb. 3, 2009, 4 pages.
Jelf-Wen, Inc. "Builders Aluminum Non-Impact Aluminum Tube Mullion Elevations & Notes" Dec. 2, 2008, 3 pages.
RW Building Consultants, Inc. "3100 Structural Mullion" Dec. 11, 2008, 2 pages.
Marvin Windows and Doors "⅜" Mullion Reinforcement Assembly Instructions," Oct. 14, 2004, pp. 1-9.
American Architectural "AAMA 450-06 Voluntary Performance Rating Method for Mulled Fenestration Assemblies" May 2006, pp. 1-23.

* cited by examiner

MULLION SYSTEM

TECHNICAL FIELD

The disclosed subject matter relates generally to window assemblies, and specifically to a reinforcing mullion system that provides greater strength and rigidity to a window system as well as allowing for water to be diverted out of the mullion and away from the building.

BACKGROUND

Mullion systems or mullions provide the central support between a divided window structure. Mullion strength is an important factor for providing wind load resistance to a window. The significance of the mullion is amplified with an increase in the number of adjacent windows and different combinations of windows sought after by builders in order to guarantee a strong window assembly. As the size of the window assembly is increased, the mullion must provide enough reinforcement to ensure the safety of the system.

Mullion systems have traditionally been designed to reinforce adjacent wall panels or windows. However, conventional mullion systems are often difficult to assemble or performance rate as complete window systems. This has limited the number of window combinations that meet new building codes and performance standards (such as AAMA 450 detailed below), especially in places where harsh conditions are a factor, such as coastal regions where hurricanes are prevalent, or in the Midwest, where tornadoes are common.

Additionally, with the increase in frequency and severity of weather events, mullion standards have been raised significantly. One of these raised standards, that has emerged as a leading standard, is the American Architectural Manufacturers Association's (AAMA) 450 Performance Rating Method for Mulled Fenestration Assemblies. It provides specifications for mullion systems with greater resistance to severe weather, than existed previously.

The AAMA 450 rating determines the air infiltration, water resistance, and structural performance of mulled fenestration assemblies. This higher standard has limited the number of suitable mullion systems that are available for multi-window constructions.

Additionally, anchored or fixed mullions are presently available in the form of "T" and "X" mullions. However, these anchored "T" and "X" mullions are formed of multiple, non-interchangeable parts and are difficult to assemble.

Furthermore, some conventional mullion systems suffer from rot and/or corrosion. For example, windows can lose their water tight seal from the time of manufacture until the time they are installed. This could be the result of stresses developed during shipping and handling, or simply improper handling and/or installation of the window system, as well as the improper assembly of the mullion itself.

SUMMARY

The disclosed subject matter provides a mullion system for use in forming an assembly of windows, that can meet all current standards, including AAMA 450. The disclosed system is formed of common parts and is easy to assemble. The disclosed system also accommodates a calculation method to determine the structural strength and safety of the system, and as such each system may be rated for safety and performance.

This disclosed system uses a reinforcement key, which is universal. The key joins reinforcement members together. The key is also designed to engage an opening in the respective gusset plate. The gusset plate is attached to the rough window opening, allowing the sharing of the wind load with the screws holding the gusset plate. The key is also designed to sit in a groove in a member, in order to join to perpendicularly disposed reinforcements. This leads to a stronger mullion system, when compared to conventional mullion systems, where the screws carried all of the wind load.

The reinforcement key, as well as the components forming the reinforcements, and gusset plates of the mullion system are universally sized. Accordingly, these components can be fit together, to form a solid reinforcing system. Also, this universal sizing allows the components to be used in "T" and "X" mullions.

The mullion system is also modular. This allows for multiple window configurations that can still meet the AAMA 450 specification. Moreover, the same components are used in all orientations and interlock the same from all orientations.

The mullion system also provides a method of diverting water away from the window units. An upper leg on a horizontal mull strip is designed to direct water toward the exterior of the window, and away from the structure.

An embodiment of the disclosed subject matter is directed to a mullion system for providing improved structural rigidity. The system includes a first component for being fastened to the frame of a first window unit; a second component for being fastened to the frame of a second window unit; and, a removably attachable reinforcement key. The key is configured for joining the first component to the second component, and a leading portion of the reinforcement key extends beyond the edges of the first component and the second component. This portion that extends is designed for receipt in a securement member, for example, a gusset plate.

Another embodiment is directed to a system for placement between parallel oriented window frames for facilitating liquid flow out of the system. The system includes a strip covered by a cap, the strip sitting between the parallel oriented window frames, the parallel orientation being either vertical or horizontal. The strip includes oppositely disposed ends, a main member including oppositely disposed first and second edges, a first lateral member extending from the main member proximate to the first edge, and a second lateral member extending from the main member proximate to the second edge. The first lateral member and the second lateral member extend substantially the same distance from the main member. There is at least one cap, and typically two caps, for covering the strip at each of the oppositely disposed ends. The caps include an inner side including at least one opening to the ambient environment, with the inner side configured for facilitating movement of liquid to the opening for egress from the cap.

Another embodiment is directed to a system for placement between vertically oriented window frames for diverting liquid. The system includes a strip for placement into a space between vertically oriented window frames, and caps, for placement at opposite ends of the strip. The strip includes oppositely disposed ends, and a main member including an upper edge and a lower edge, a first lateral member protruding from the main member proximate to the lower edge, and, a second lateral member protruding upward from the main member proximate to the upper edge. The first lateral member and the second lateral member extend at least substantially the same distance as the main member. The caps are designed to frictionally fit in an area formed by the ends of the strip and portions of the window frames. The caps include an inner side and at least one opening to the ambient environment, the inner side designed for receiving and facilitating movement of liquid to the opening for egress from the at least one cap.

BRIEF DESCRIPTION OF THE DRAWINGS

Attention is now directed to the drawing figures, where like or corresponding numerals indicate like or corresponding components. In the drawings.

DETAILED DESCRIPTION

In this document, references are made to directions, such as upper, lower, top, bottom, up, down, upward, downward, front, rear, side, lateral, right, left, inner, outer, inside, outside, and variations thereof. These directional references are exemplary, to show the disclosed subject matter in an example orientation, and are in no way limiting.

Figure 1A:
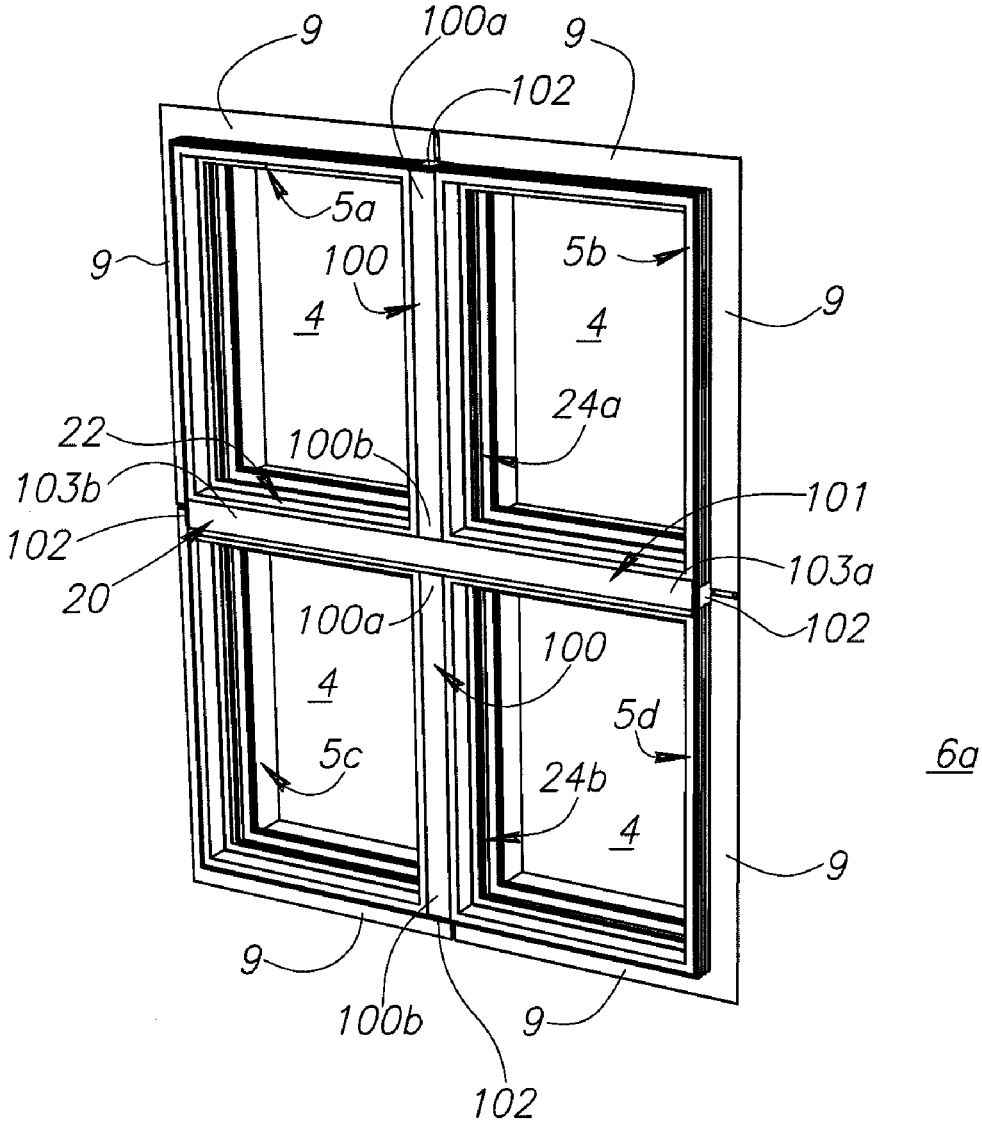
FIG. 1A is a perspective view of a window system installed in a rough opening of a building using the disclosed mullion system.
Figure 1B:
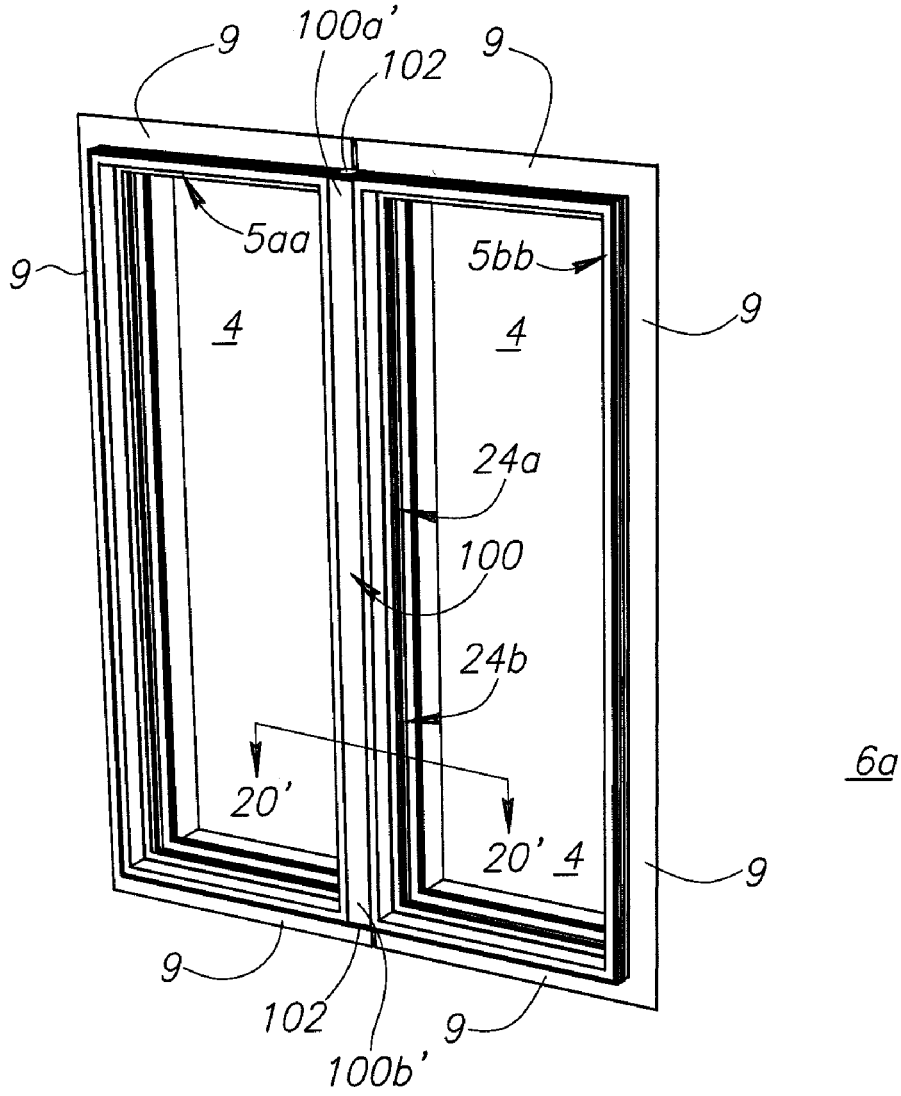
FIG. 1B is a perspective view of a window system of two windows with a vertical mull strip between them, installed in a rough opening of a building using the disclosed mullion system.

FIG. 1A shows the mullion system of the disclosed subject matter in an exemplary operation, supporting windows 4 in frames 5*a*-5*d*, in an opening 6 (FIG. 2), as seen from the outside or outer wall 6*a* of a building, structure or the like. The frames 5*a*-5*d* include fins 9 (also known as nail fins) that cover space in the opening 6 (also referred to herein as a window opening, window frame opening or rough opening) not filled by the frames 5*a*-5*d*. FIG. 1B is similar, except that the mullion system is employed on two windows 4 in window frames 5*aa*, 5*bb*, respectively, joined horizontally.

Figure 2:
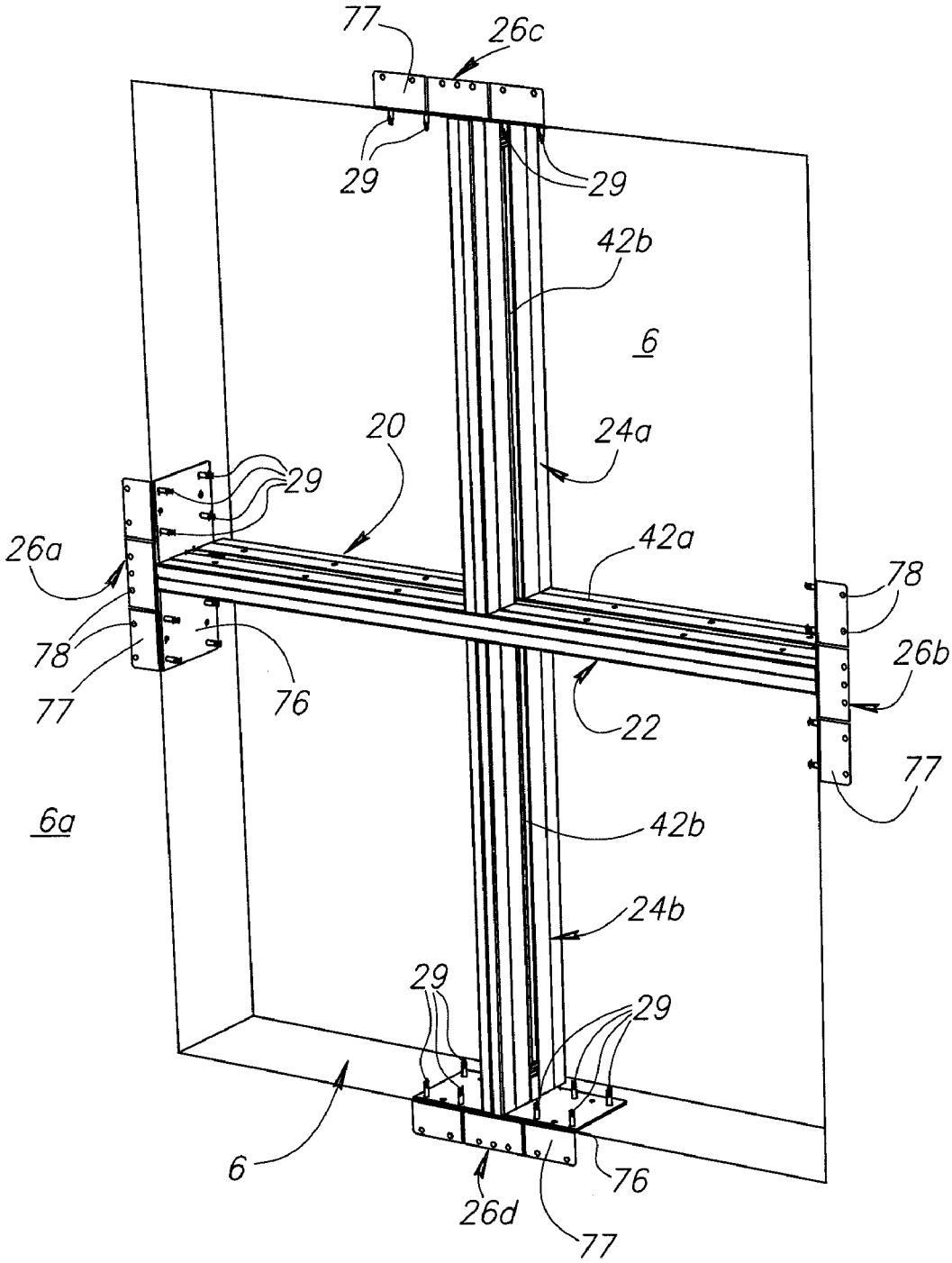
FIG. 2 is perspective view of the mullion system installed inside a rough opening with the window frames removed.

FIG. 2 is the same view as FIG. 1A, showing the mullion system 20 reinforcements 22, 24*a*, 24*b*, that support the window frames 5*a*-5*d*. The reinforcement system would be similar for the windows frames 5*aa*, 5*bb* of FIG. 1B, and is in accordance with the system described below. The mullion system 20 includes a horizontal reinforcement 22 that supports vertical reinforcements 24*a* (upper), 24*b* (lower). The horizontal reinforcement 22 is received in oppositely disposed gusset plates 26*a* (left, with respect to the paper), 26*b* (right, with respect to the paper). The vertical reinforcements 24*a*, 24*b* are supported by frictional interlocks with the horizontal reinforcement 22 and receipt in the respective gusset plate 26*c* (upper, with respect to the paper), 26*d* (lower, with respect to the paper). The gusset plates 26*a*-26*d* attach to the opening 6 and the outer wall 6*a* of the opening, through fasteners 29, for example, nails and the like and also including adhesives and the like.

Figure 3:
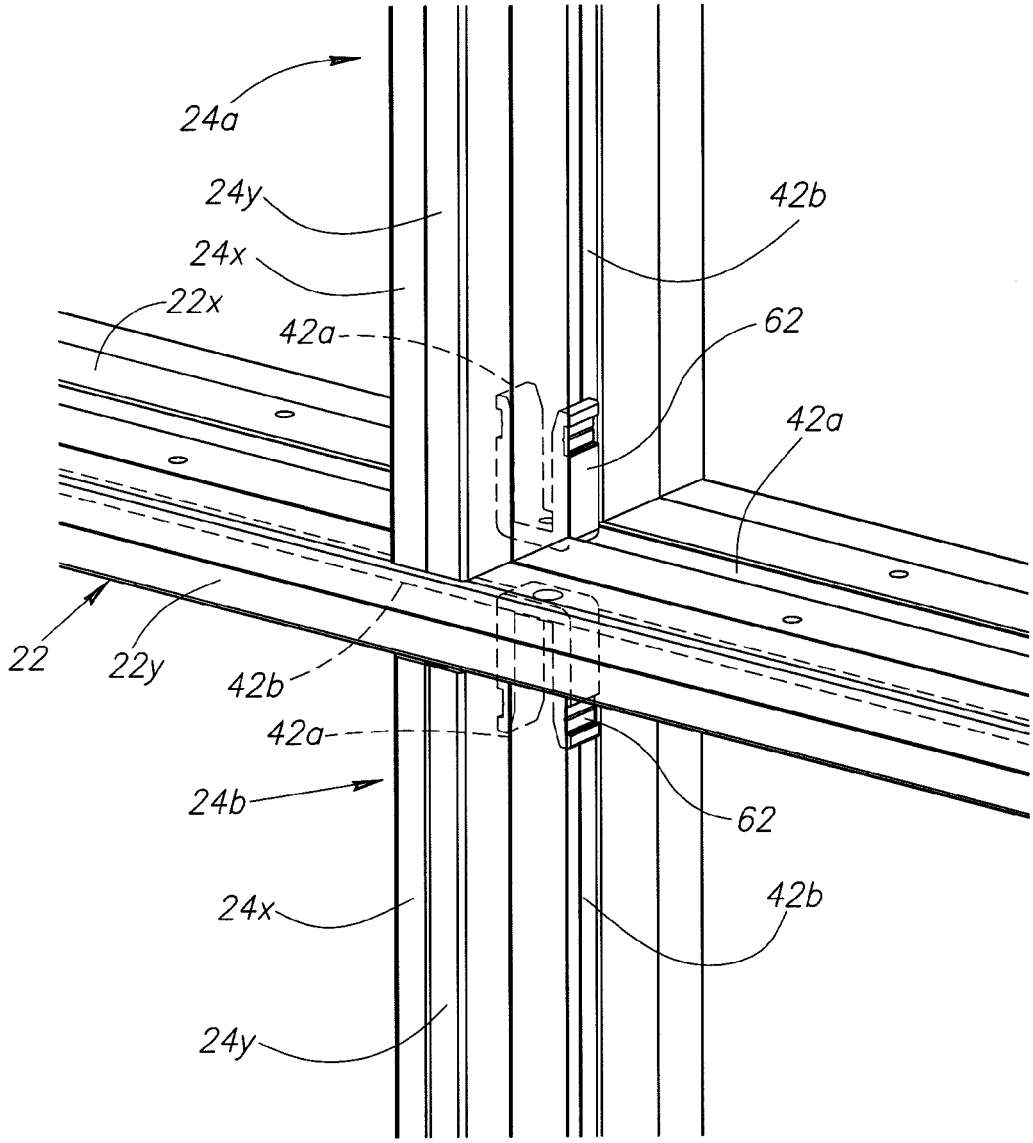
FIG. 3 is a close up of the interior connection of the mullion system of FIG. 2.

FIG. 3 shows the horizontal reinforcement 22 and vertical reinforcement 24*a*, 24*b* in greater detail. Each reinforcement 22, 24*a*, 24*b* is formed of paired members 22*x*, 22*y* and 24*x*, 24*y*, that include interengaging components, for joining and retaining the members 22*x*, 22*y*, 24*x*, 24*y* together (shown in FIGS. 5A and 5B and detailed below). Each of the members 22*x*, 22*y*, 24*x*, 24*y* may be joined to the window frame 5*a*-5*d* either before or during the overall mounting process of the mullion system. The members 24*x*, 24*y* are shown joined by a key 62 (detailed below), at least a portion of each key 62 seating in the groove 42*a*, 42*b* on the outer surface 44*a*, 44*b* of the respective members 22*x*, 22*y* (the structure of the members 22*x*, 22*y*, 24*x*, 24*y* and the key 62 detailed further below).

Figure 4:
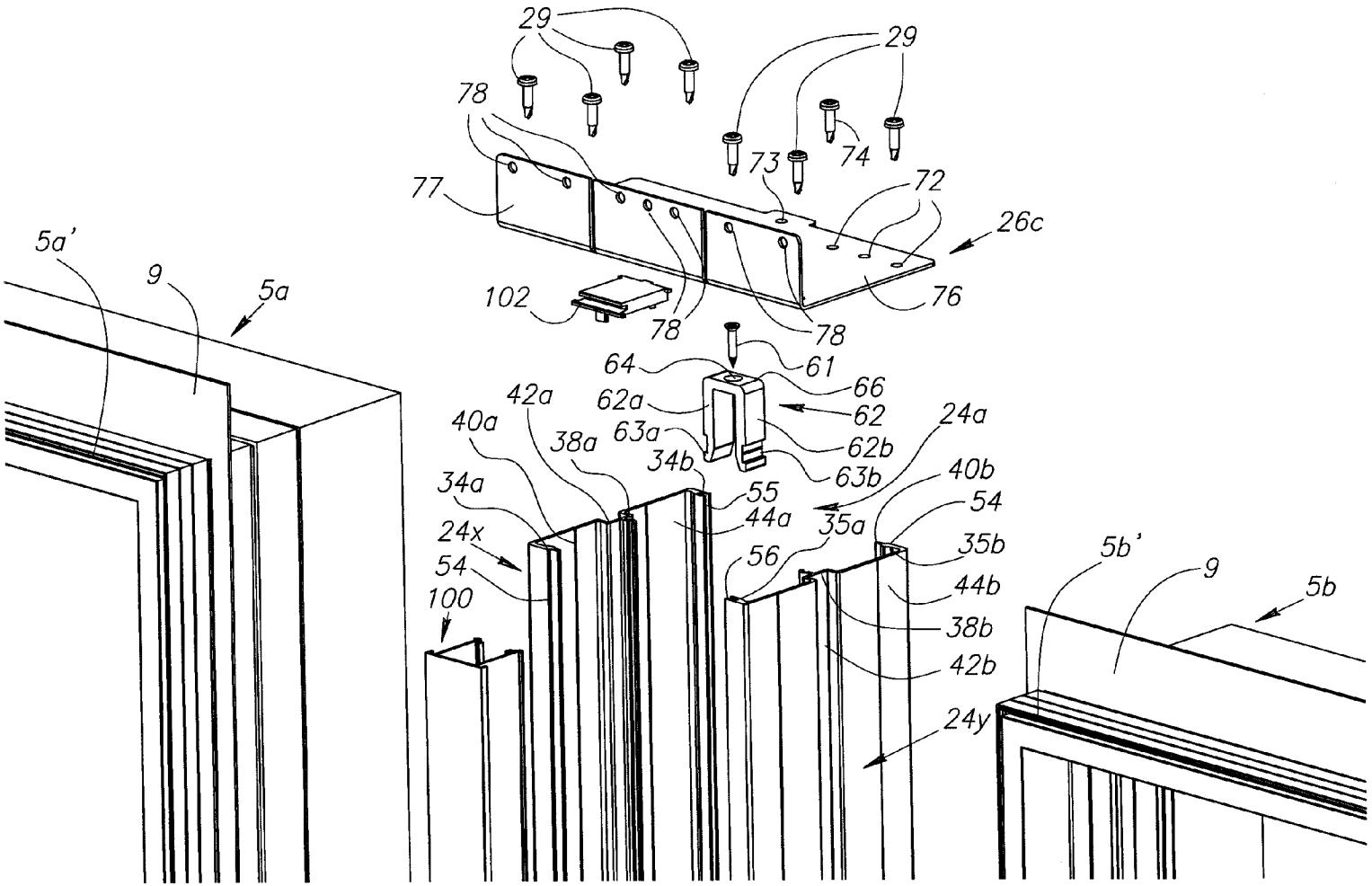
FIG. 4 is an exploded view showing a vertical portion of the disclosed mullion system.

FIG. 4 shows the mullion system 20 in an exploded view, as viewed from the upper vertical reinforcement 24*a*. Each member 24*x*, 24*y* attaches to the respective window frame 5*a*, 5*b*. Additionally, the features of the members 24*x*, 24*y* discussed below are also applicable to members 22*x* and 22*y*, that for purposes of discussion, are similar except for their orientation in the window opening 6.

Each member 24*x*, 24*y*, as well as members 22*x*, 22*y*, are made, for example, from extruded materials such as steel, aluminum, plastic or the like. The members 24*x*, 24*y*, as pairs, include inwardly bent ends 34*a*, 34*b*, 35*a*, 35*b*, and an inwardly protruding ridge 38*a*, 38*b*, intermediate the bent ends 34*a*, 34*b*, 35*a*, 35*b*, for example, at the midpoint. The inwardly protruding ridge, 38*a*, 38*b* on the inner surface 40*a*, 40*b* of each member 24*x*, 24*y*, is shaped to correspond to a groove 42*a*, 42*b* on the outer surface 44*a*, 44*b* of each member 24*x*, 24*y*.

Figure 5A:
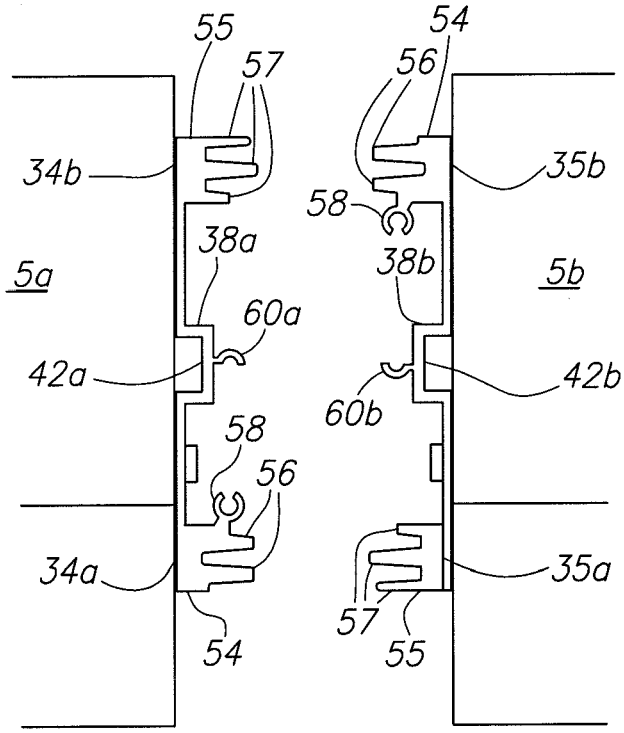
FIG. 5A is a cross-sectional view of a paired members of a mullion reinforcement including finger portions.

The ends 34*a*, 34*b* of one member 24*x* include finger portions 54, 55 that are correspondingly configured with finger portions 55, 54 on the ends 35*a*, 35*b* of the other member 24*y*, to form, for example, male-female friction fits, between the fingers 56, 57. For example, each member 24*x*, 24*y* includes one male finger portion 54 of, for example, two fingers 56, and one female finger portion 55, of three fingers 57, as shown in FIG. 5A. The finger portions 54 may include a screw boss 58 attached thereto for receiving screws 74 that secure the gusset plate 26*a*-26*d* to the respective reinforcement 22, 24*a*,

24*b*, as detailed below. For example, this arrangement of finger portions 54, 55 is referred to as a High Performance Reinforcement.

Figure 5B:
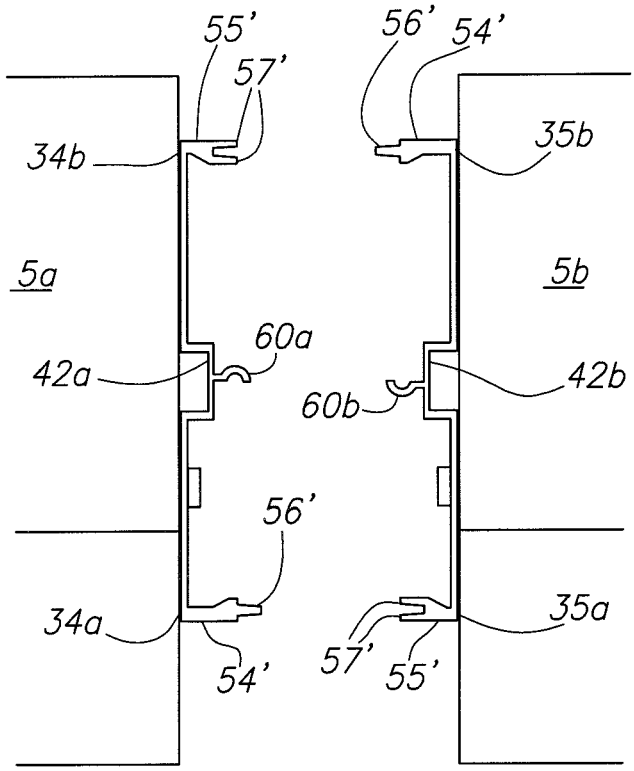
FIG. 5B is a cross-sectional view of alternate finger portions of FIG. 5A.

Alternately, the arrangement of finger portions 54, 55 on the ends 34*a*, 34*b*, 35*a*, 35*b* of the respective members 24*x*, 24*y* can be replaced with the arrangement of FIG. 5B, with male finger portions 54' on each of the members 24*x*, 24*y*, of one finger 56, and female finger portions 55' on each of the members 24*x*, 24*y*, respectively, with two fingers 57. For example, this arrangement of finger portions 54', 55' is referred to as a Standard Performance Reinforcement.

While the High Performance and Standard Performance reinforcements with finger portions 54, 55 are shown, there may be embodiments of members 24*x*, 24*y* where these finger portions 54, 55 are not present.

The distances between the fingers 56, 57 and 56', 57' are such that the fingers are received in a frictionally snug engagement, sufficient to keep the members 24*x*, 24*y* (and also of the lower vertical reinforcement 24*b* and horizontal reinforcement members 22*x*, 22*y*) held together until physically separated.

In both FIGS. 5A and 5B, at the ridge 38*a*, 38*b* are links 60*a*, 60*b*. These links 60*a*, 60*b* are, in the embodiment shown, "question mark" shaped, extend from the ridges 38*a*, 38*b* for interlocking with each other. The "C" shaped portions of the links 60*a*, 60*b*, when brought together define a boss (screw boss) 60 (FIG. 13A) for receiving a screw 61, that secures a key 62, to the respective reinforcement 22, 24*a*, 24*b*. The screw 61 is a non structural screw, as it serves only an attachment (securement) function.

The key 62 includes arms 62*a*, 62*b* that are of a width to seat in the grooves 42*a*, 42*b* of the respective members 24*x*, 24*y*. The arms 62*a*, 62*b* terminate in rounded portions 63*a*, 63*b* that extend outward, to facilitate engagement of the joined members 24*x*, 24*y*. The arms 62*a*, 62*b* are of a thickness, to fit within the space of the grooves 42*a*, 42*b* and not extend outside of the grooves 42*a*, 42*b* (remaining approximately flush with the respective outer surface 44*a*, 44*b*). The key 62 includes an opening 64 in its cross bar 66, the opening 64 for receiving the screw 61. The cross bar 66 extends between the arms 62*a*, 62*b*, giving the key 62 a "U" shape. The key 62 is, for example, a unitary member of metal, that holds the members 24*x*, 24*y* together by a clamping-type engagement. When attached and fastened to the members 24*x*, 24*y*, the key 62, extends beyond the edges of the joined members 24*x*, 24*y*.

Figure 6A:
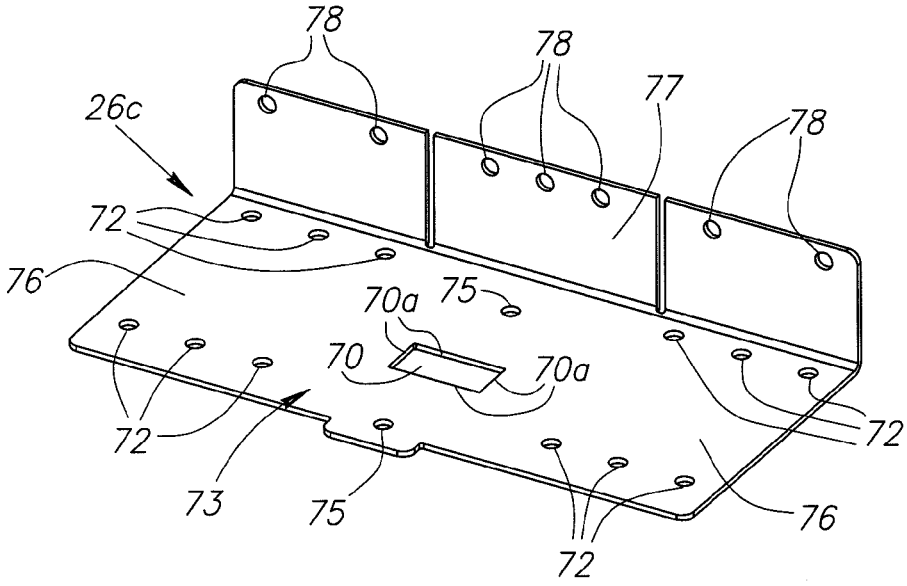
FIGS. 6A and 6B are perspective views of gusset plates of the disclosed mullion system.

FIG. 6A shows a gusset plate 26*c*, exemplary of the other gusset plates 26*a*, 26*b* and 26*d*, with an opening 70, that is designed for receiving the cross bar portion 66 of the key 62 (that extends from the respective reinforcement 22, 24*a*, 24*b*). The gusset plate 26*c* is designed to attach to the window frames 5*a*, 5*b* to the rough opening 6, via fasteners 29, that are load bearing. The fasteners 29, for example, screws, nails, rivets, etc., extend through openings 72 in the body 73 of the gusset plate 26*c*. Screws 74 (FIG. 7) extend through openings 75 in the body 73 (that align with the screw bosses 58), for receipt in the screw bosses 58, for additional securement of the reinforcements 22, 24*a*, 24*b* to the respective gusset plates 26*a*-26*d*. The end portion 77 of the gusset plate 26*c* is also, for example, oriented perpendicular to the body 73, and includes openings 78 for fasteners, that attach the gusset plate 26*c* and the window frames 5*a*, 5*b* to the outer wall 6*a* of the building. This end portion 77, for example, is positioned behind the fins 9 of the frames 5*a*, 5*b*.

Figure 6B:
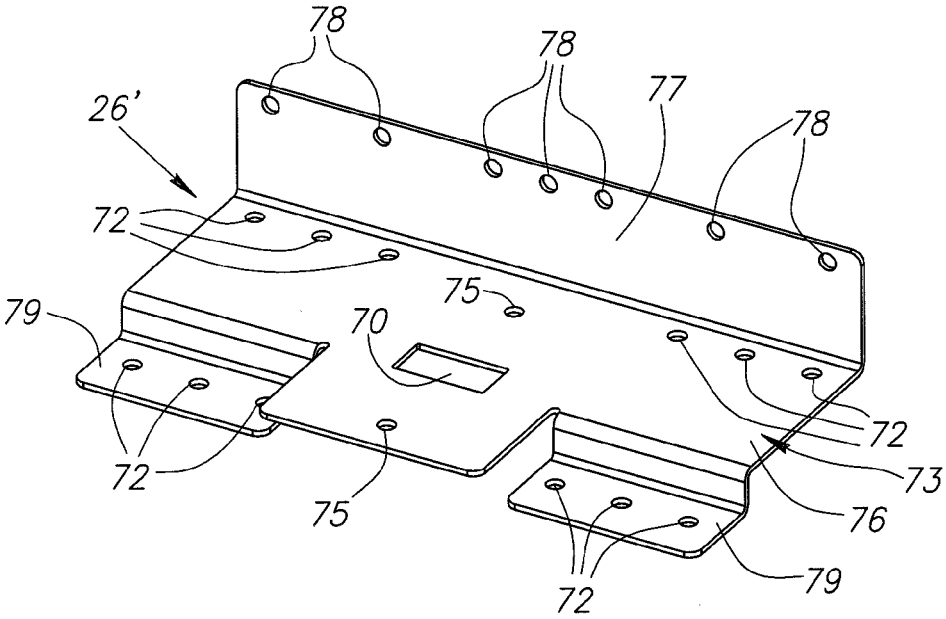

FIG. 6B is similar to FIG. 6A (like or identical components have the same numbers) and shows an alternate gusset plate 26'. This gusset plate includes platforms 79 on the end opposite the end portion 77, for accommodating double hung window frames.

Returning to FIG. 4, a mull strip or strips 100 (with ends 100*a* (e.g., upper), 100*b* (e.g., lower), as shown in FIG. 1A (multiple, with ends 100*a*, 100*b*) and 1B (single, with ends 100*a'*, 100*b'*)) is covered by a cap 102 (at ends 100*a* and 100*b* in FIG. 1A and 100*a'* (e.g., upper) and 100*b'* (e.g., lower) in FIG. 1B), that is clamped between the window frames 5*a*, 5*b*, 5*c*, 5*d* (FIG. 1A) and 5*aa* and 5*bb* (FIG. 1B), at the reinforcements 24*a*, 24*b* (shown for FIG. 1A). The mull strip 100 is on the outside surface of the window frames 5*a*, 5*b*, 5*c*, 5*d*, and 5*aa*, 5*bb*, and is exposed to the ambient environment. The mull strip or strips 100, as detailed below, are designed to move water out of the mull cavity 104, to the ambient environment, to inhibit rust formation, undue wear of the window frame components, rotting, or other untimely spoilage of the window frame components. This discussion is also applicable to the mull strip 101 (FIG. 1A), that is a single strip extending horizontally between window frames 5*a* and 5*c* and 5*b* and 5*d*. Alternately, in FIG. 1A, the vertical mull strip 100 may be a single strip bisecting multiple horizontal mull strips (each horizontal mull strip similar in construction to mull strip 101), in accordance with the discussion herein.

Figure 7:
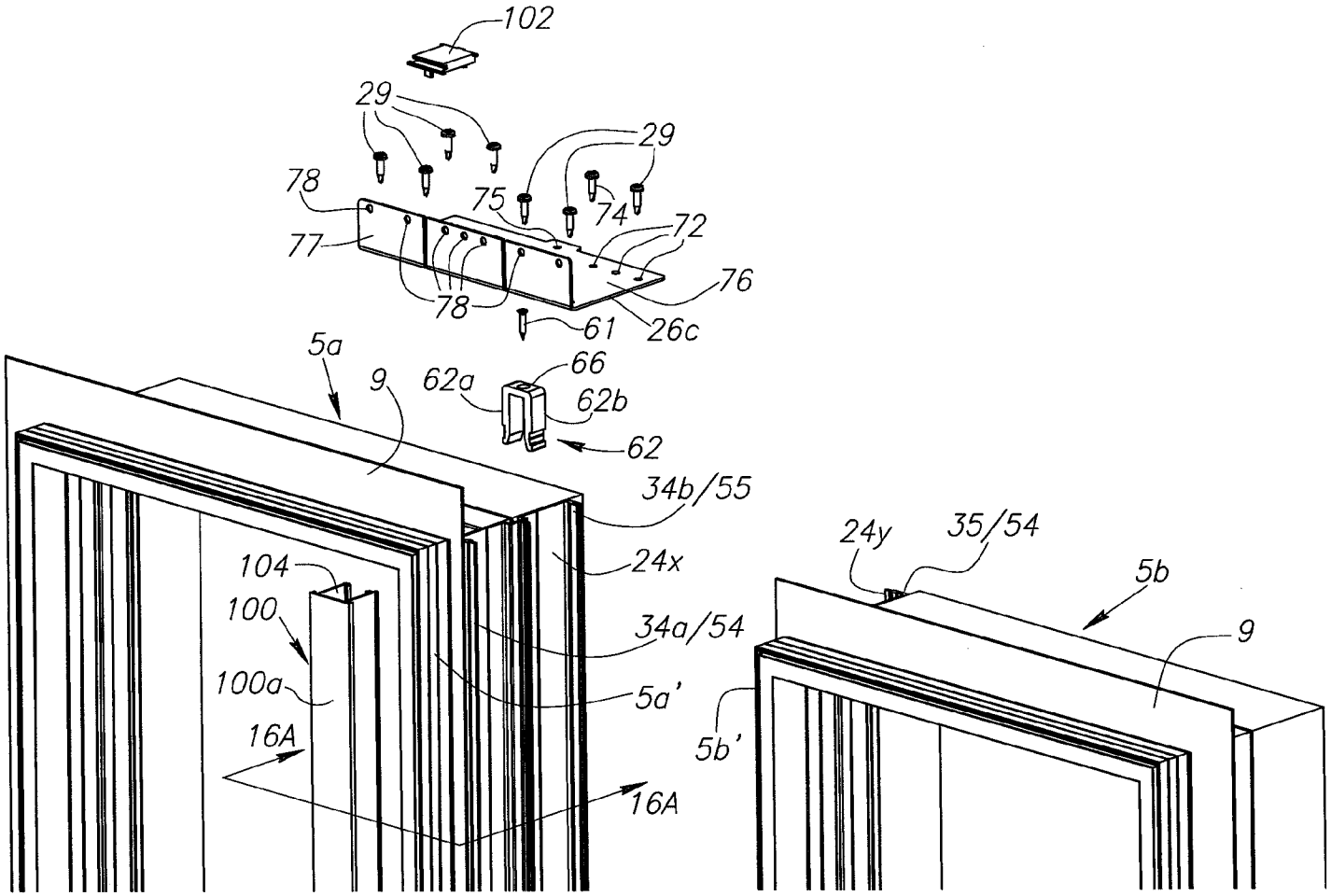
FIGS. 7, 8A, 8B, 9, 10 are exploded views of a sequence of assembly steps for the vertical reinforcement of the disclosed mullion system.

Attention is now directed to FIGS. 7-11 to show assembly of the mullion system of the disclosed subject matter, for example, the upper vertical reinforcement member 24*a*. In FIG. 7, the members 24*x*, 24*y* are attached to the window frames 5*a*, 5*b*, respectively. The attachment is with fasteners 29, such as nails, screws, rivets and the like and may also involve adhesives.

Figure 8A:
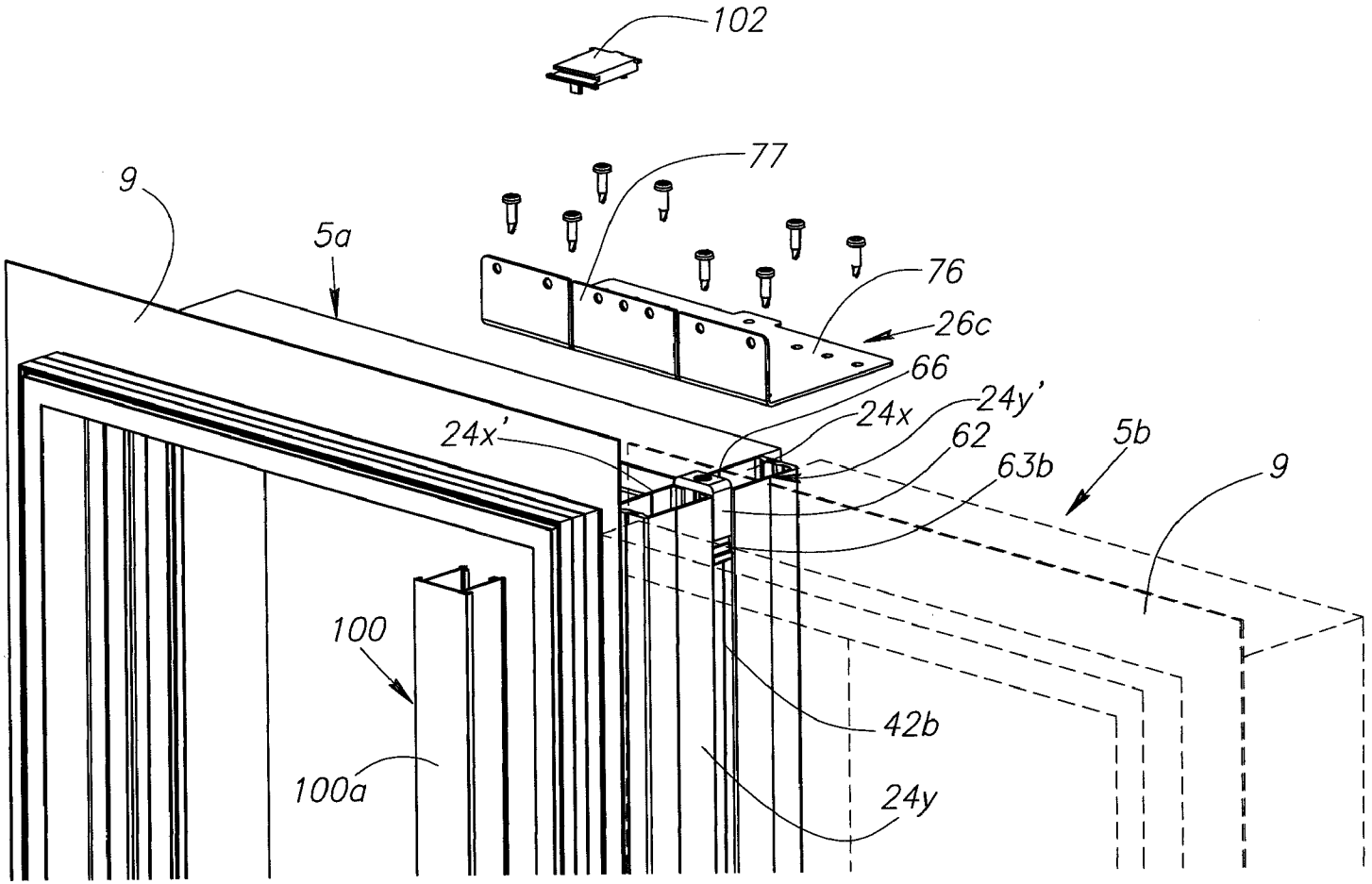
Figure 8B:
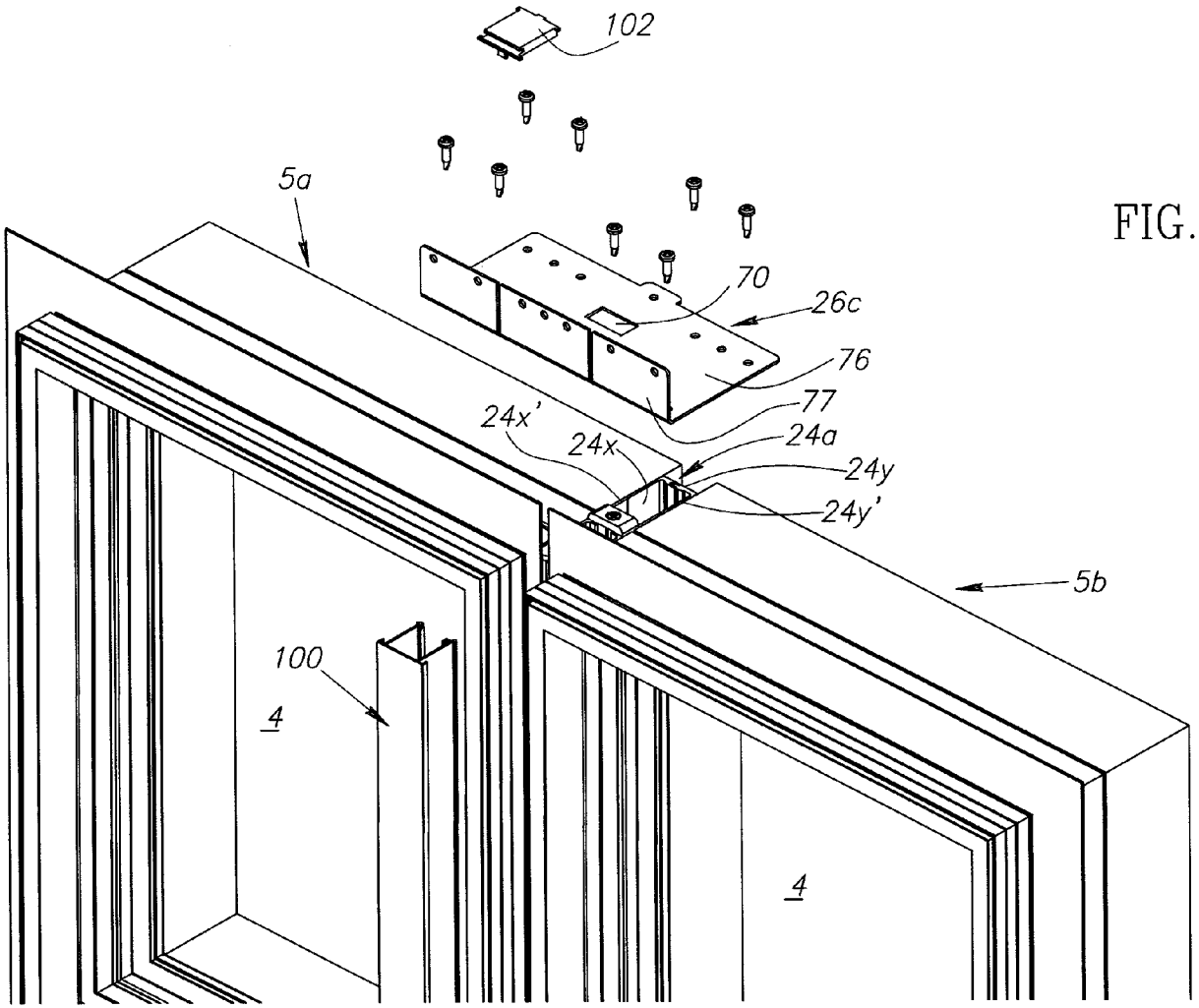

In FIGS. 8A and 8B, the members 24*x*, 24*y* are now brought together as the fingers 54, 55 (FIG. 5A) interlock and the links 60*a*, 60*b* (FIG. 5A) come together to define a screw boss 60. The key 62 is pushed downward, into contact with the members 24*x*, 24*y* and its arms 62*a*, 62*b* rest in the respective grooves 42*a*, 42*b*. Downward movement stops when the crossbar 66 of the key 62 abuts the edges 24*x'*, 24*y'* of the members 24*x*, 24*y*.

Figure 9:
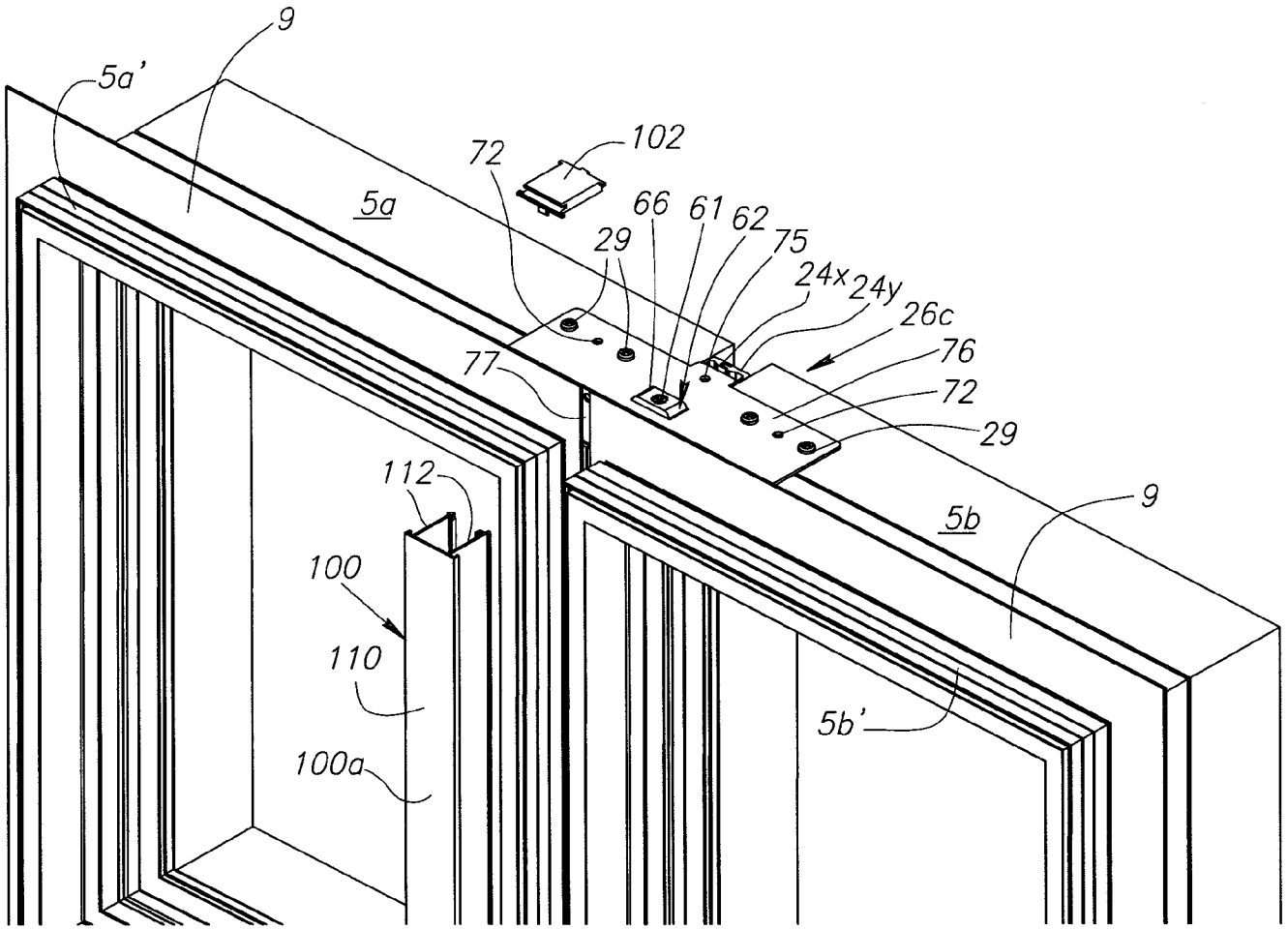

The gusset plate 26*c* is now attached to the joined frames 5*a*, 5*b*, as shown in FIG. 9. Orientation of the gusset plate 26*c* is such that the opening 70 is placed around the key 62 proximate the crossbar 66 and the key 62 is surrounded by the sidewalls 70*a* of the opening 70, where movement would cause an abutment with one or more of the sidewalls 70*a*, such that the key remains in place in the gusset plate 26*c*. This positioning of the key 62 allows some of the wind load on the window frames 5*a*-5*d* to be transferred to the key 62, such that the aforementioned wind load is distributed among the key 62 and the gusset plate fasteners 29.

Figure 15:
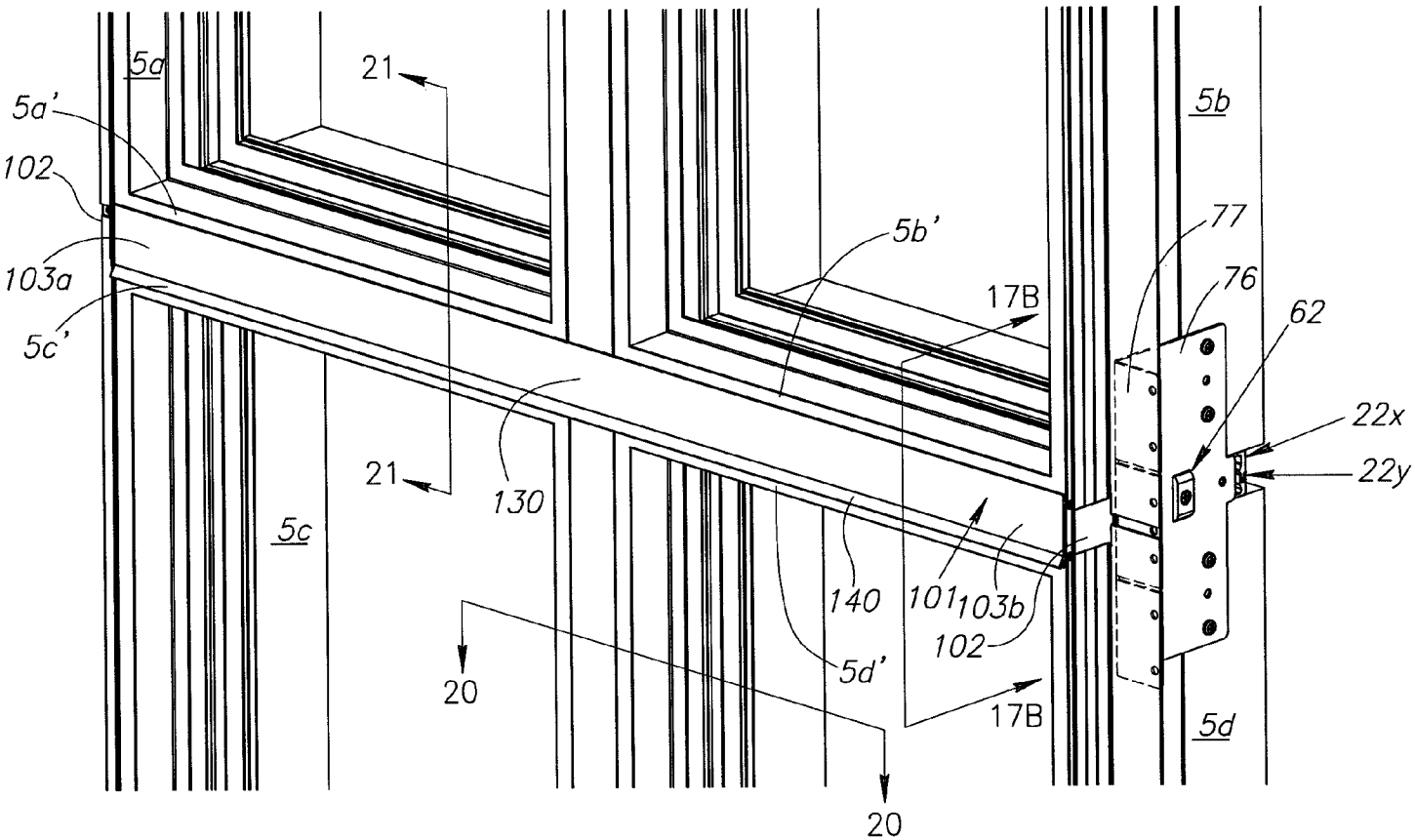
FIG. 15 is a perspective view of the completed assembly of the horizontal reinforcement of the disclosed mullion system.

The lower end of the vertical member 24*a* is joined similarly with a key 62 and screw 61. The extending crossbar 66 of the key 62 will seat in the groove 42*a* of the horizontal member 22*x*, as shown in FIGS. 2, 3 and 15.

Figure 10:
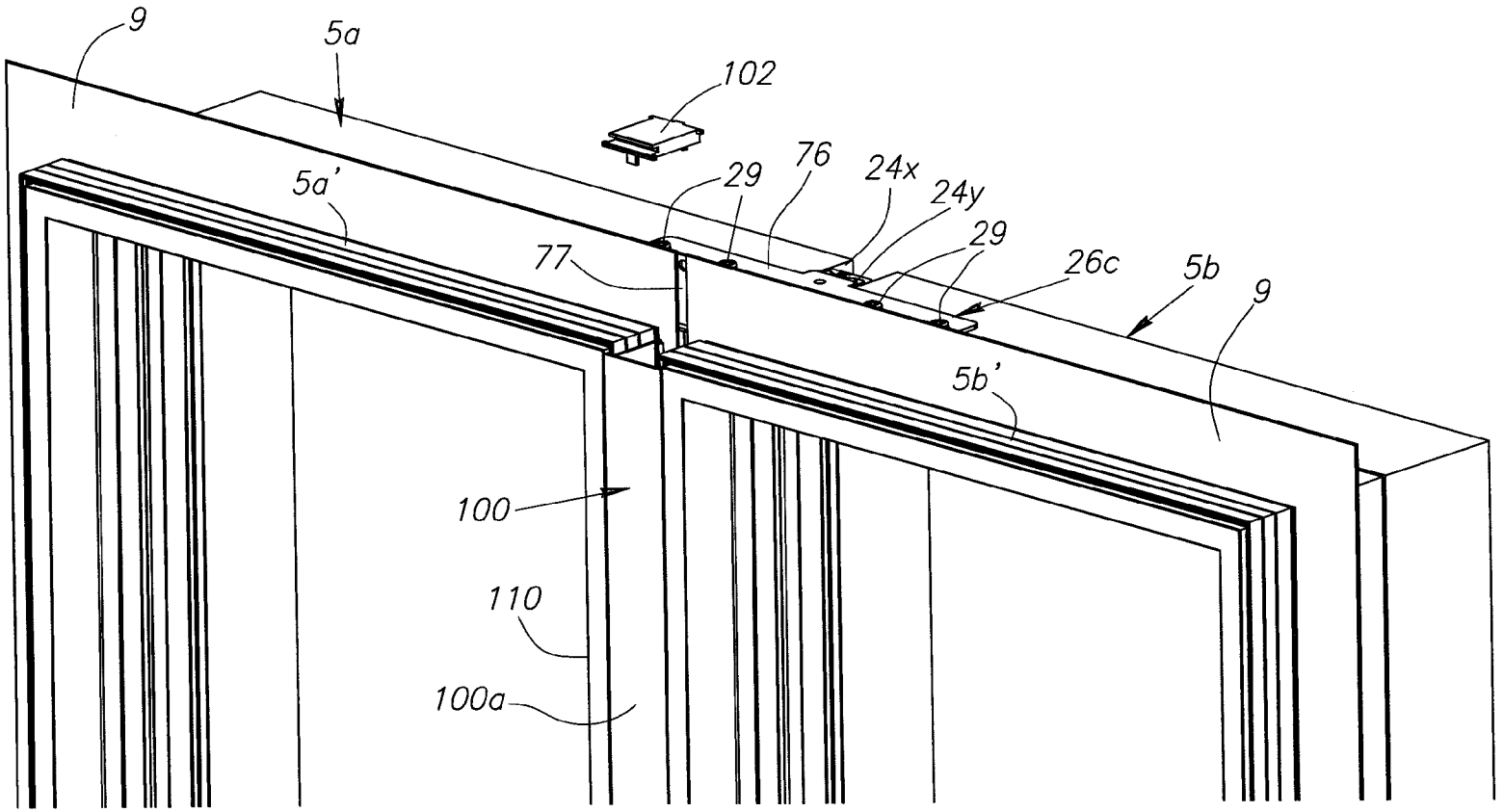
Figure 11:
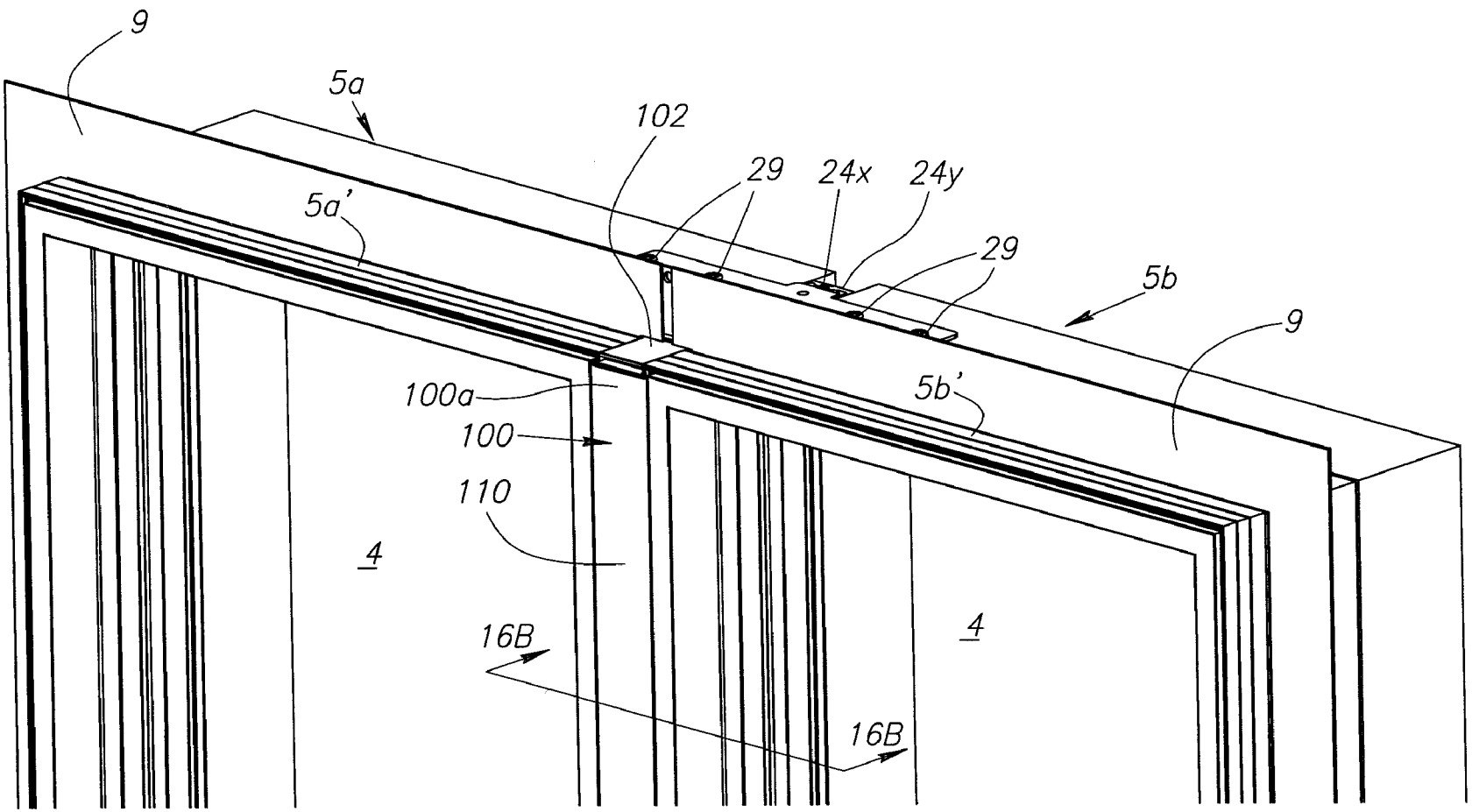
FIG. 11 is a perspective view of the completed assembly of the vertical reinforcement of the disclosed mullion system.

The mull strip 100 is placed between the window frame edges 5*a'*, 5*b'*, and it snaps into place, due to the resiliency of the materials from which it is made (e.g., aluminum, polymers, plastics, elastomers), as shown in FIG. 10. As shown in FIG. 11, a cap 102 is joined to the mull strip 100 at its upper end 100*a* (of the upper mull strip 100), and at the lower end 100*b* of the lower mull strip 100 (as shown in FIG. 1A). The cap 102 closes the mull cavity 104 of the mull strip(s) 100. The cap 102 may be frictionally fit into the mull strip 100, and this attachment may be facilitated with additional adhesives and other adhesive techniques. The mull strips 100 are described in greater detail below and shown in FIGS. 16A and 16B.

The lower vertical reinforcement 24*b* is constructed similarly and assembled as detailed above. The extending crossbar 66 of the key 62 will seat in the groove 42*b* of the horizontal member 22*x*, as shown in FIGS. 2, 3 and 15, at the upper end of the vertical reinforcement 24*b*, and in the opening 70 of the gusset plate 26*d* at the lower end of the vertical reinforcement 24*b*.

Attention is now directed to FIGS. 12-15 to show assembly of the mullion system of the disclosed subject matter, from the standpoint of the horizontal reinforcement 22, formed of paired members 22*x*, 22*y*. The additional components are the same as detailed above, only in a horizontal orientation. Although a single side of the reinforcement members 22*x*, 22*y* is shown, the reinforcement members 22*x*, 22*y* are symmetric and accordingly, applies equally to the side not shown, the side that engages the gusset plate 26*a*.

Figure 12:
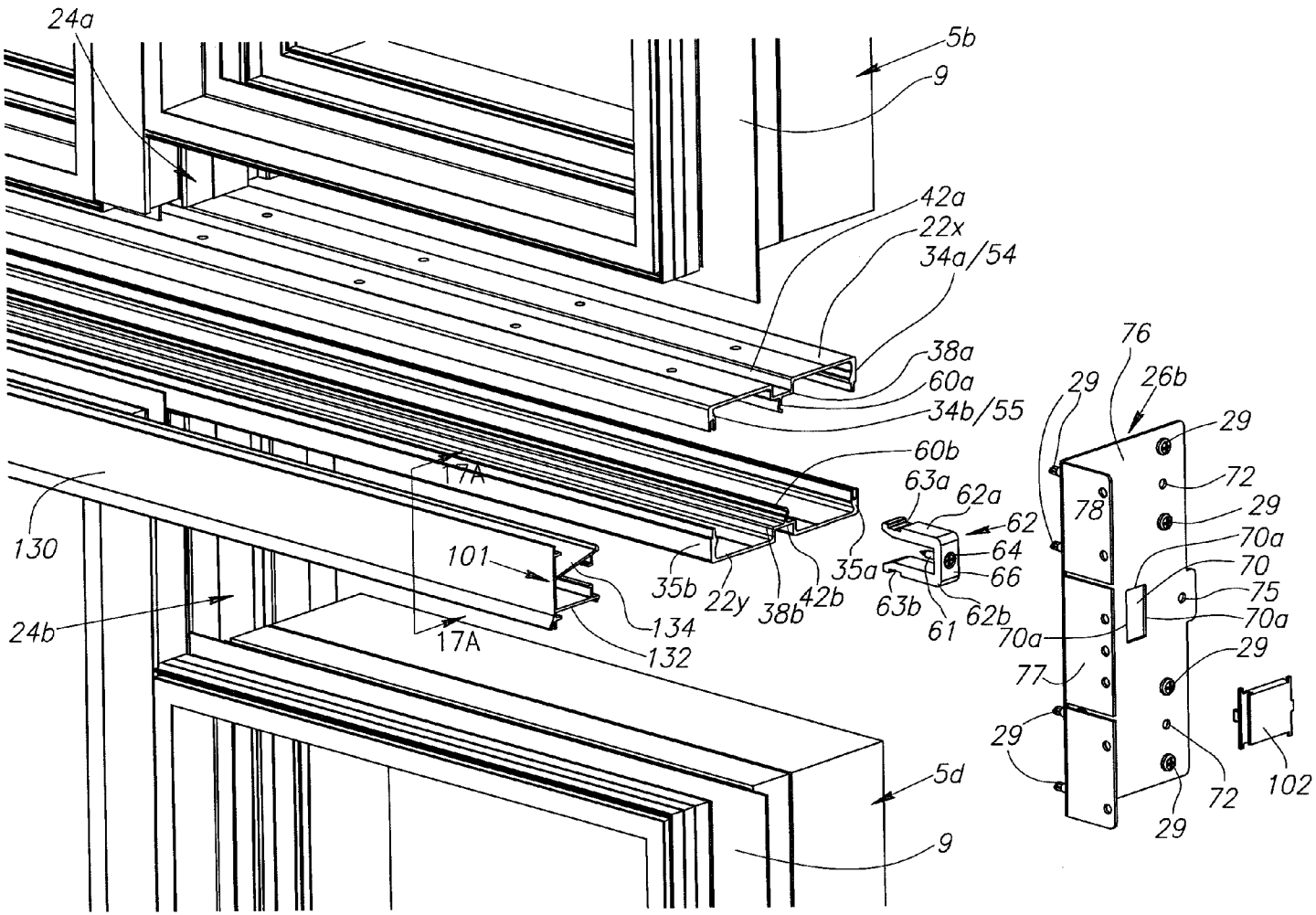
FIGS. 12, 13A, 13B and 14 are exploded views of a sequence of assembly steps for the horizontal reinforcement of the disclosed mullion system.
Figure 13A:
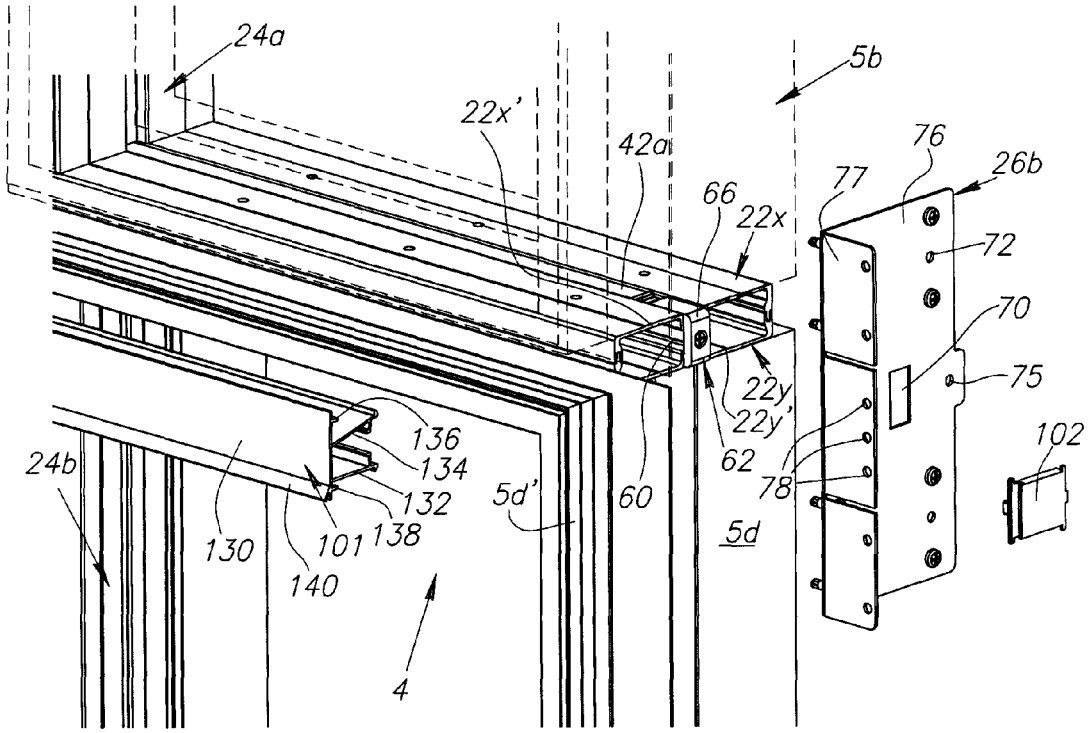
Figure 13B:
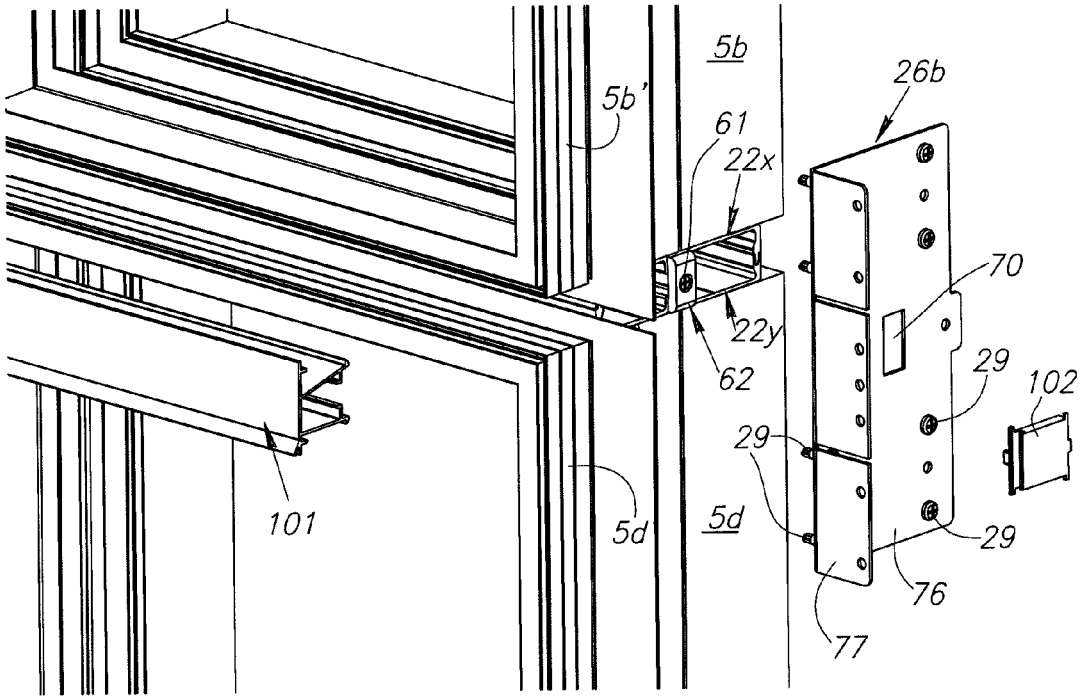

FIG. 12 is an exploded view of all of the components of the mullion system. In FIGS. 13A and 13B, the members 22*x*, 22*y* have been attached to the window frames 5*a*, 5*c* and 5*b*, 5*d*, and are joined together by interlocking of the respective finger portions 54, 55, and secured by the key 62, that seats in the grooves 42*a*, 42*b* (the crossbar 66 abutting the edges 22*x*', 22*y*' of the members 22*x*, 22*y*). The key 62 is held in place by a screw 61, as detailed above.

Figure 14:
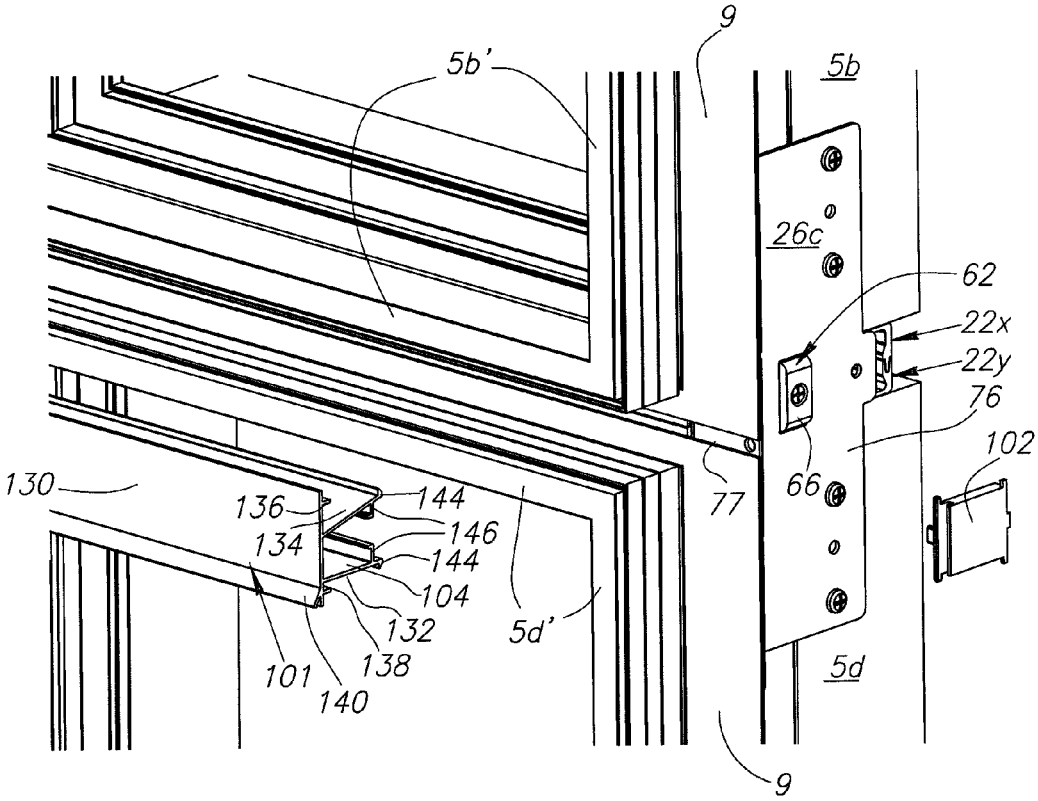

The gusset plate 26*b* is now attached to the joined frames 5*b*, 5*d*, as shown in FIG. 14. Orientation of the gusset plate 26*b* is such that the opening 70 is placed around the key 62 proximate the crossbar 66 and the key 62 is surrounded by the sidewalls 70*a* of the opening 70, where movement would cause an abutment with one or more of the sidewalls 70*a*. The end portion 77 of the gusset plate 26*b* is close to or in abutment with the fins 9 of the window frames 5*b*, 5*d*.

In FIG. 15, the mull strip 101 is placed between the window frame edges 5*a*', 5*c*' and 5*b*', 5*d*', and it snaps into place, due to the resiliency of the materials from which it is made, as detailed above. Caps 102 are joined to the mull strip 101 at both lateral ends 103*a*, 103*b*, to close the cavity 104 (FIG. 16A) of the mull strip 101, as detailed above. Like the mull strip 100, mull strips 101, 101', detailed below, are designed to move water out of the mull cavity 104 (FIG. 16A), to the ambient environment, to inhibit rust formation, undue wear of the window frame components, rotting, or other untimely spoilage of the window frame components.

FIGS. 16A-18B detail vertical 100 and horizontal 101, 101' mull strips. The vertical mull strip 100 has been shown in FIGS. 1A, 1B, 4, 5 and 7-11, while the horizontal mull strip 101 has been shown in FIGS. 1A, 12-15. Mull strip 101' is an alternate horizontal mull strip.

Figure 16A:
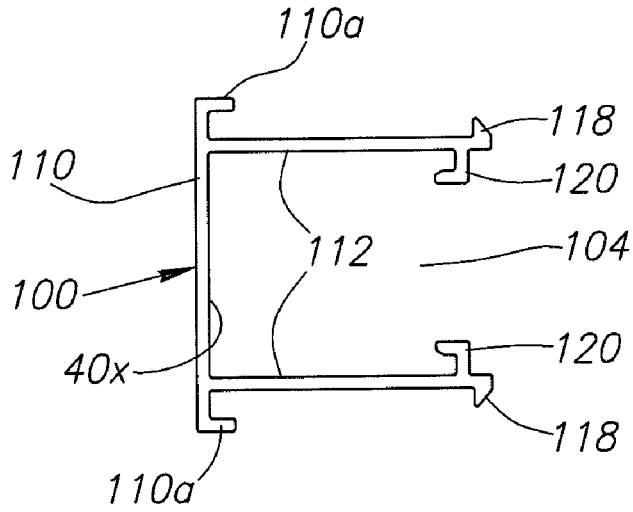
FIG. 16A is a cross sectional view of the mull strip taken along line 16A-16A of FIG. 7.

The vertical mull strip 100 of FIG. 16A is symmetric, and, for example, "C" shaped. A cross member 110 includes oppositely disposed lateral members 112. The cross member 110 includes inwardly extending arms 110*a* for engaging slots 115 in the window frame edges 5*a*', 5*b*' (that may include screw bosses 5*x* that receive joining screws and the like), an inner surface 110*x*. The lateral members 112 terminate in outwardly extending flanges 118, and inwardly extending "L" shaped tabs 120. These tabs 120 are used in mull strip 100 removal from the space (gap) between the window frame edges 5*a*', 5*b*'.

Figure 16B:
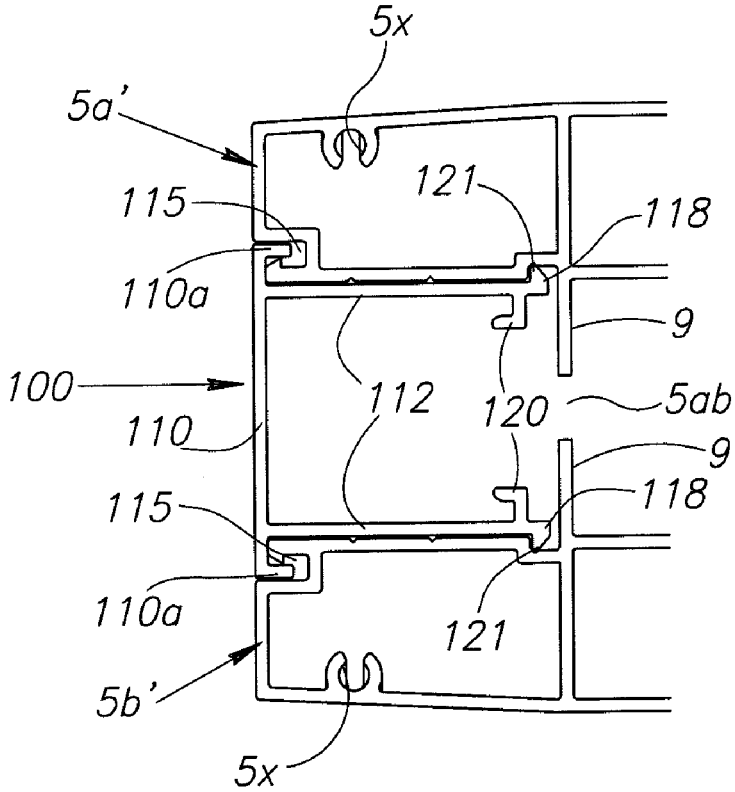
FIG. 16B is a cross sectional view of the mull strip in the window frame taken along line 16B-16B of FIG. 11.

As shown in FIG. 16B, the cross member 110 faces the ambient environment (outside), while the lateral members 112 are inside the space between the window frame edges 5*a*', 5*b*'. The flanges 118 of the lateral members 112, engage shoulders 121 of the window frame edges 5*a*', 5*b*'. The flanges 118 are tapered, to facilitate inward sliding of the mull strip 100, until the flanges 118 snap into place in the shoulders 121. The tabs 120 serve to keep water within the mull strip 100, so that it may drain properly.

Figure 17A:
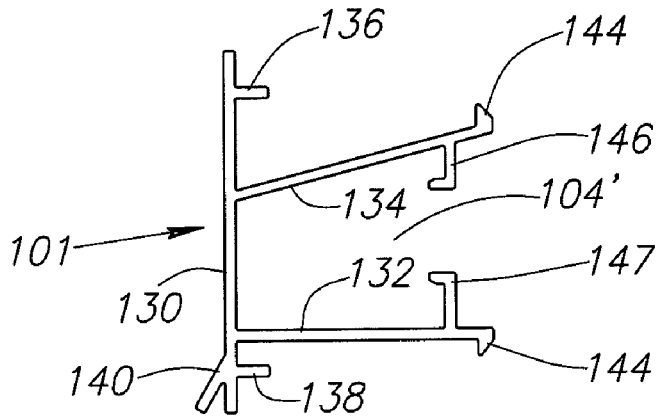
FIG. 17A is a cross sectional view of the mull strip taken along line 17A-17A of FIG. 12.
Figure 17B:
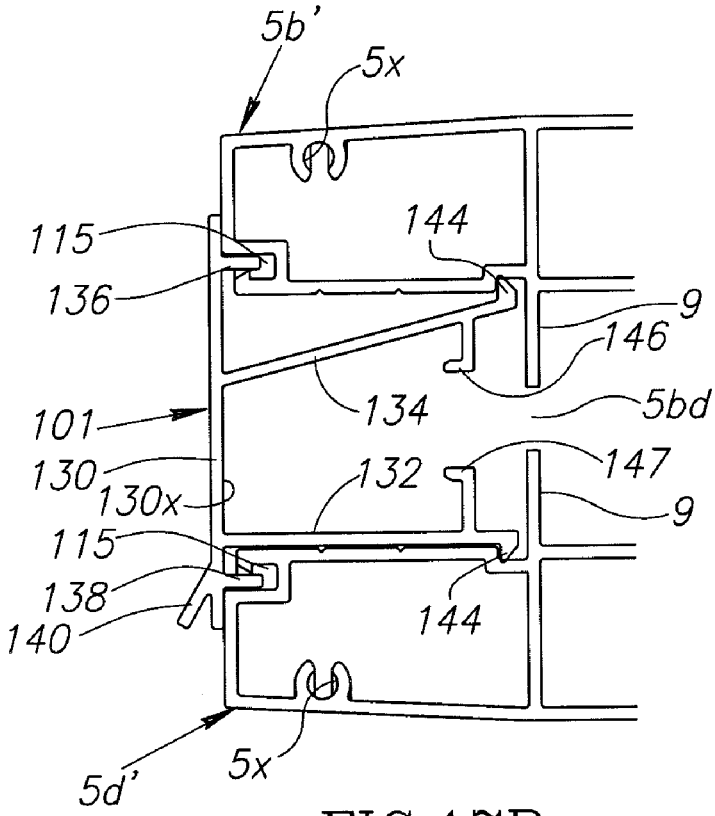
FIG. 17B is a cross sectional view of the mull strip in the window frame taken along line 17B-17B of FIG. 15.

In FIG. 17A, the horizontal mull strip 101 includes a cross member 130, with an inner surface 130*x* (FIG. 17B). The cross member 130 contacts the ambient environment, with a perpendicular lateral member 132 and an upwardly (outwardly) angled lateral member 134. Turning also to FIG. 17B, inwardly protruding stubs 136 (upper) 138 (lower) are designed to engage slots 115 in the window frame edges 5*a*', 5*c*' and 5*b*', 5*d*'. An outwardly protruding ledge or ledge member 140 extends angularly from the cross member 130, to direct water away from the mull strip 101, and forms the lower end of the mull strip 101. The lateral members 132 terminate in outwardly extending flanges 144, that function similarly to the flanges 118, and inwardly extending "L" shaped tabs 146 (upper), 147 (lower). These tabs 146, 147 function similarly to tabs 120 for the mull strip 100, with the tab 147 also operable to keep water within the mull strip 101, so that it may drain properly.

In operation, the upwardly angled lateral member 134 allows water to move toward the exterior of the mullion system, such that it drains out via the mull caps 102. As shown in FIG. 17B, the mull strip 101 is oriented such that the upwardly angled lateral member 134 defines the upper side of the mull strip 101, while the angularly protruding ledge or ledge member 140 defines the lower side of the mull strip 101.

Figure 18A:
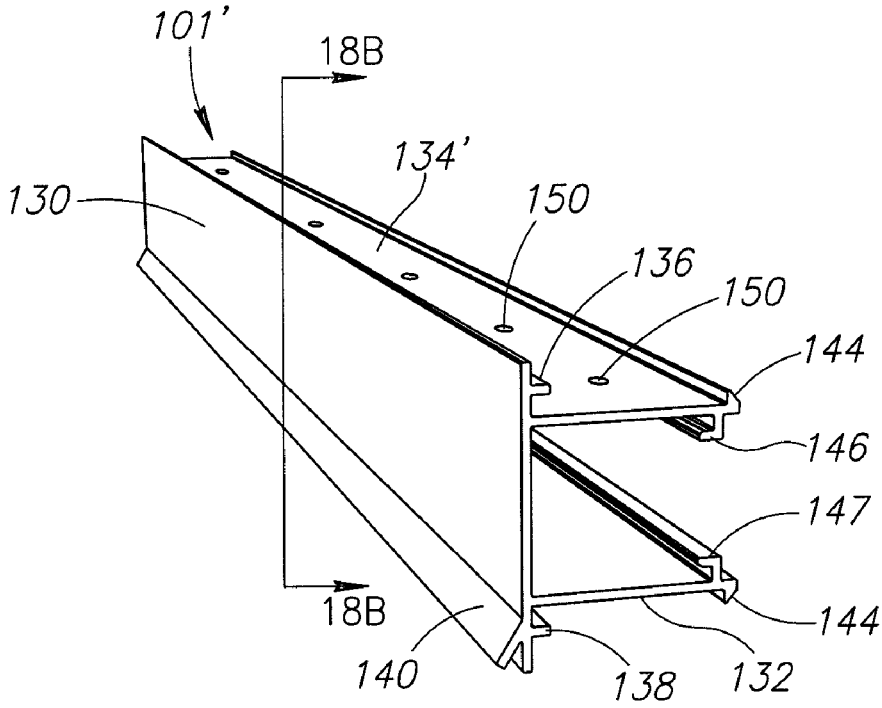
FIG. 18A is a perspective view of an alternate mull strip.
Figure 18B:
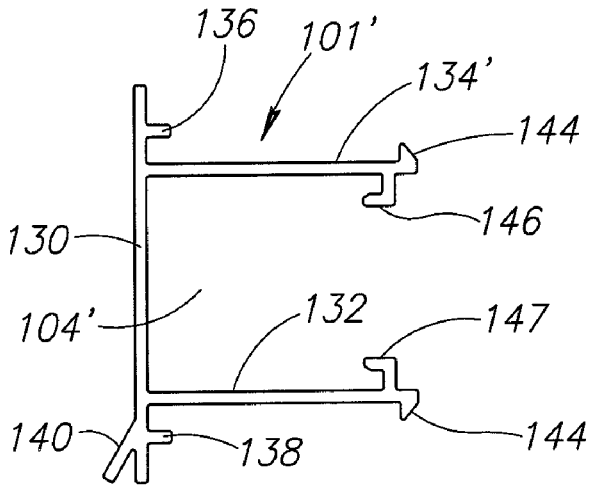
FIG. 18B is a cross sectional view of the mull strip of FIG. 18A taken along line 18B-18B.

The horizontal mull strip 101' of FIGS. 18A and 18B is similar to the mull strip 101, except that a perpendicularly oriented (with respect to the cross member 130) member 134' is the upper lateral member. This upper lateral member includes indicia 150 (FIG. 18A) where openings may be cut or drilled, to facilitate water drainage, or the indicia may be replaced by openings. In operation, the mull strip 101' is oriented such that the upwardly lateral member 134' defines the upper side of the mull strip 101', while the angularly protruding ledge or ledge member 140 defines the lower side of the mull strip 101'.

Figure 19A:
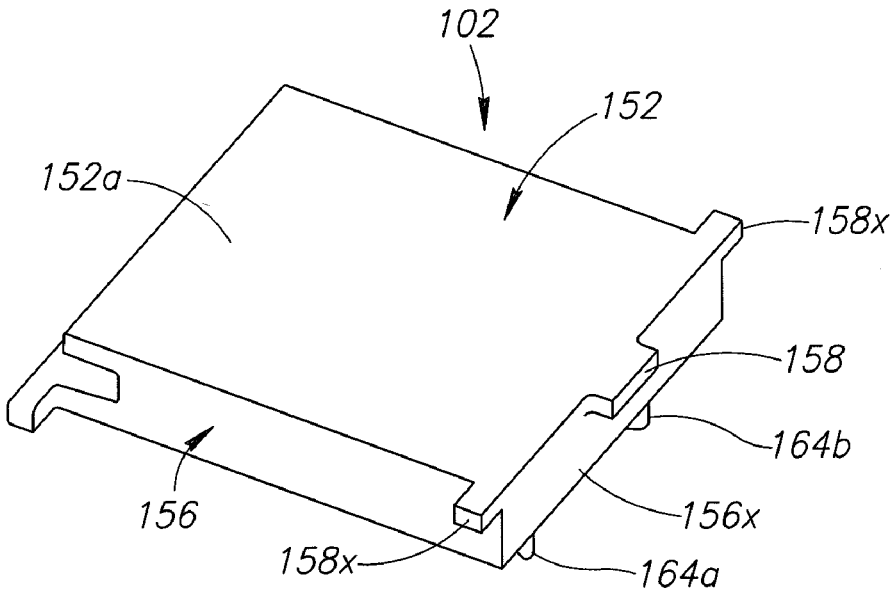
FIG. 19A is a perspective view of the outer side of a mull cap.
Figure 19B:
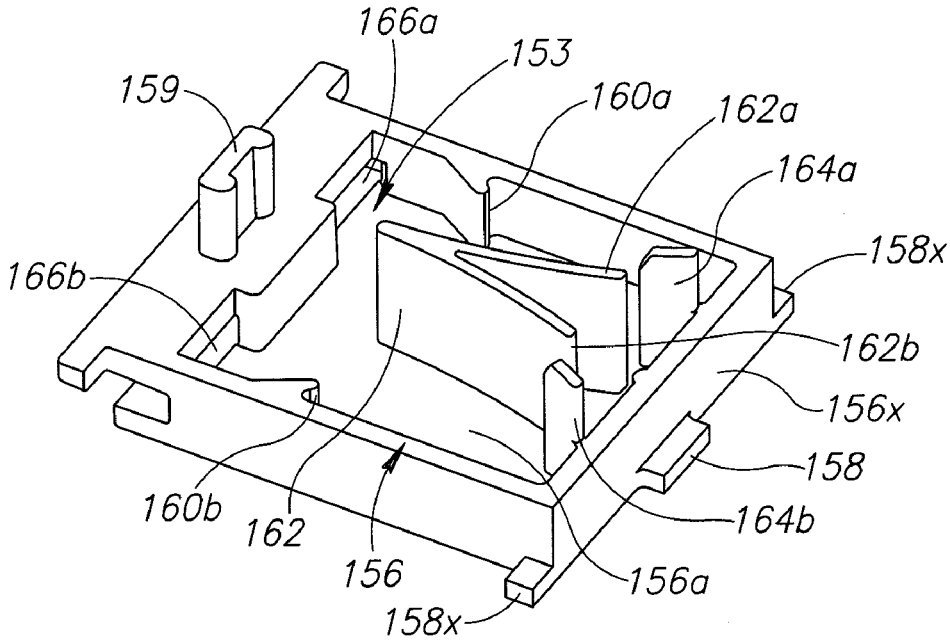
FIG. 19B is a perspective view of the inner side of the mull cap of FIG. 19A.

FIGS. 19A and 19B show the mull cap 102, from its outer side 152 (FIG. 19A) and its inner side 153 (FIG. 19B). The cap 102 includes a peripheral wall 156, with a wall segment 156*x*, from which a protrusion 158 extends. This protrusion 158 is, for example, flush with the outer surface 152*a*. This protrusion 158 is received in a slot 5*ac* formed between the joined window frames 5*a*, 5*c* (shown in FIG. 21A as exemplary for the entire system 20, and joined window frames 5*b* and 5*d*). Ears 158*x*, that are optional, extend from the segment 156*x*, and provide additional surface for a friction fit, as detailed below. The segment 156*x*, protrusion 158, and, if provided, the ears 158*x*, frictionally engage the nail fins 9 (detailed in FIGS. 20 and 21A below).

Another protrusion 159 extends from the inner side 153. This protrusion 159 serves to frictionally engage to the mull strip 101 at its closed side. The cap 102 may be additionally secured to the mull strip 101 by adhesives and the like.

Figure 21A:
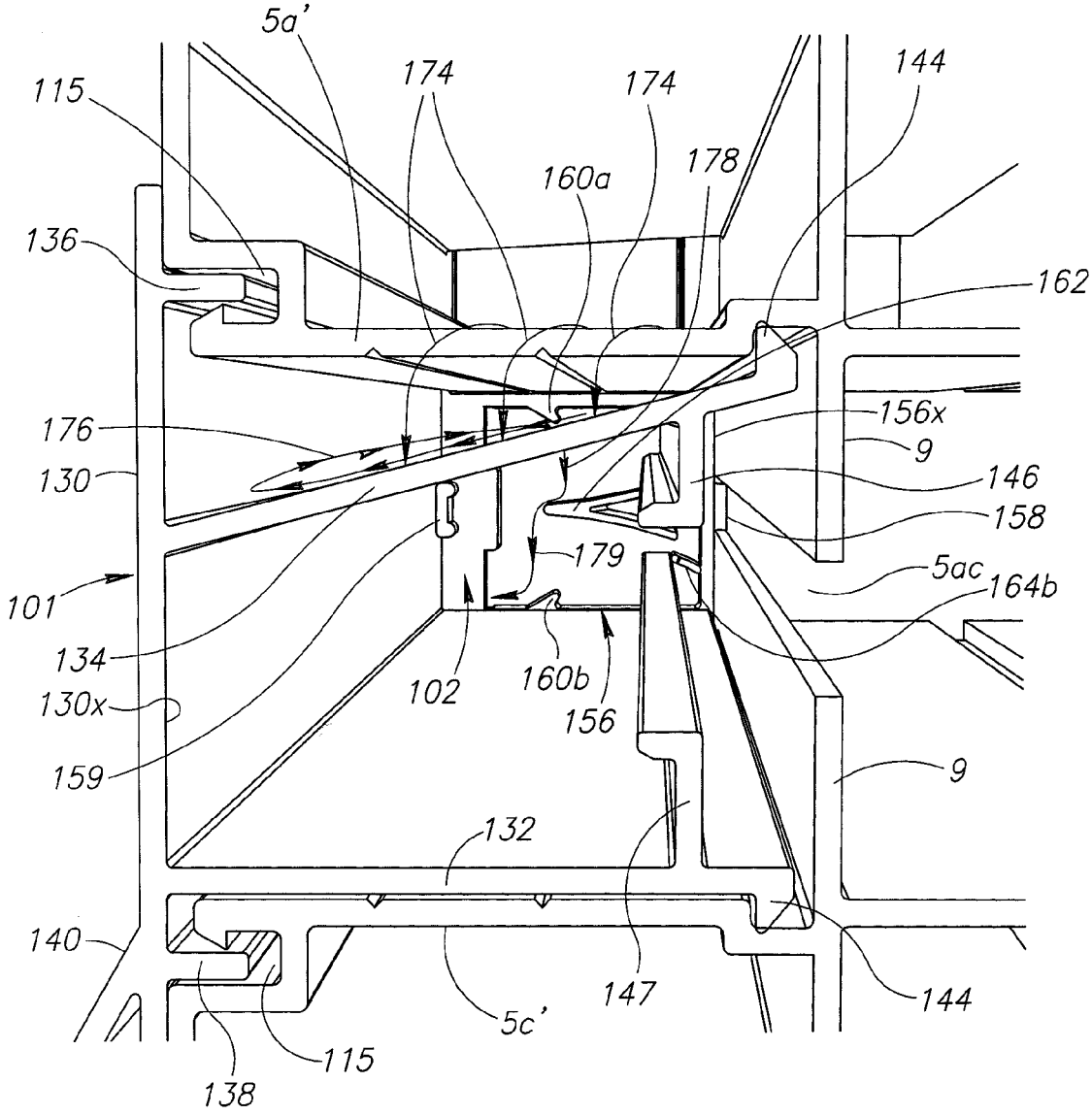
Figure 21B:
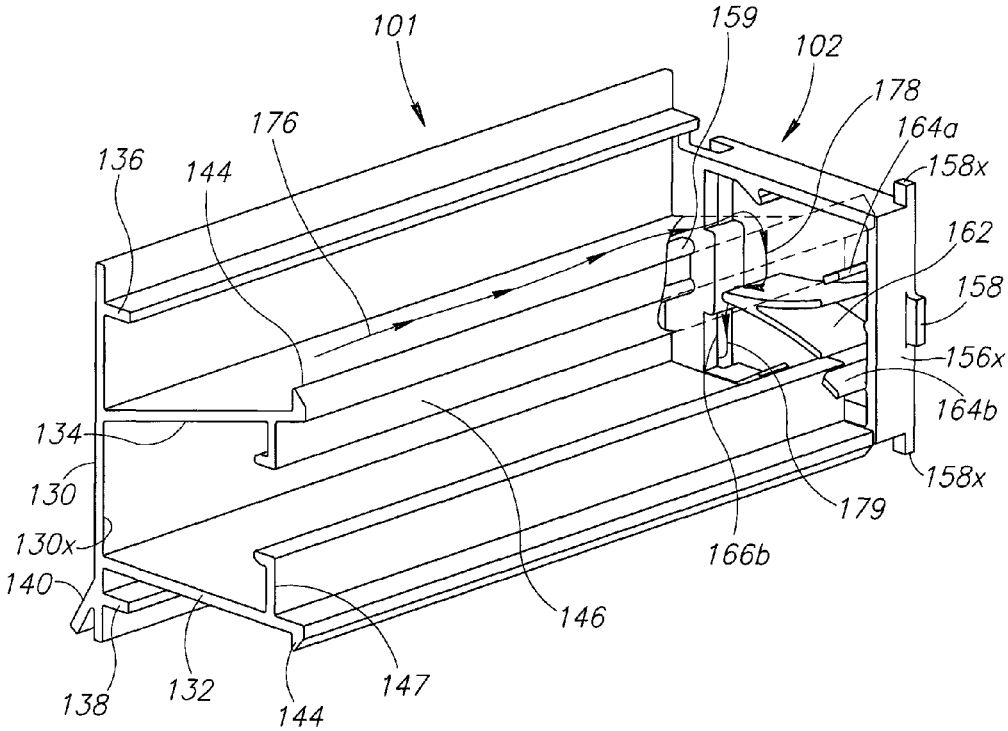

The inner side 153 of the cap 102 includes veins 160*a*, 160*b* that extend from the peripheral wall 156 and are oriented to direct water downward (toward vein 160*b*), when the cap 102 is engaged on the mull strip 101, as shown in FIGS. 21A and 21B. A V-shaped main vein 162 extends from the inner surface 156*a* of the inner side 153 and is oriented also to direct water downward, toward the vein 160*b*. The main vein ends 162*a*, 162*b* coupled with stubs or stub members 164*a* and 164*b*, that extend from the peripheral wall 156, cooperate to function in engaging the cap 102 to the mull strip 101 by frictionally contacting the respective tabs 146, 147 of the mull strip 101. Openings, also known as weep holes, 166*a*, 166*b* are proximate to the veins 160*a*, 160*b* at the front end of the cap 102.

Figure 20:
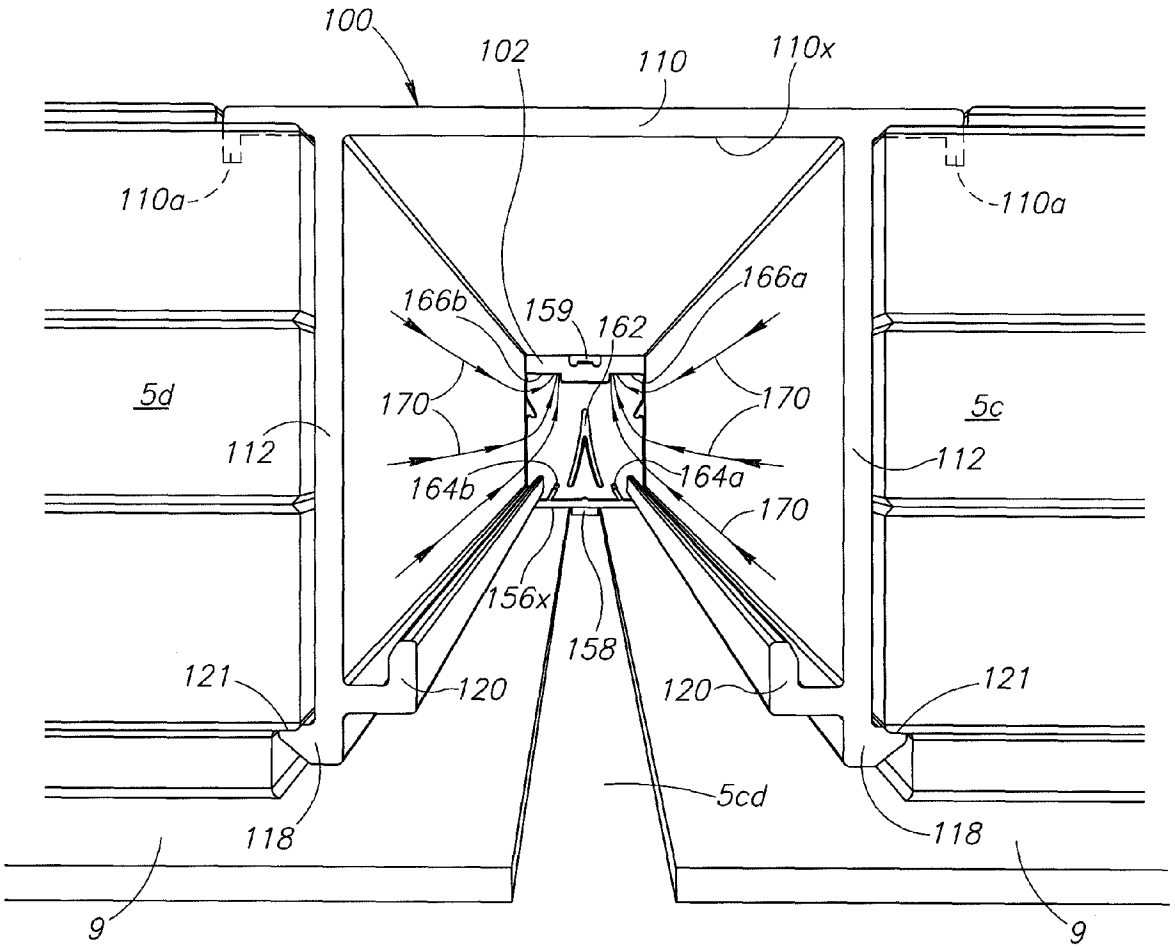
FIG. 20 is a perspective view of the inside of the capped mull strip taken along line 20'-20' of FIG. 1B and 20-20 of FIG. 15, showing fluid flow therethrough; and, FIGS. 21A and 21B are perspective views of the capped mull strips taken along line 21-21 of FIG. 15, and showing the flow of fluid therethrough.

FIG. 20 shows the cap 102 mounted on a mull strip 100 and the mounting of the cap 102/mullstrip 100 as a vertical member in window frame members 5*c* and 5*d*, with a slot (gap) 5*cd* between the corresponding fins 9 of the respective window frames 5*c*, 5*d*. These figures also show a pathway for the water through the mull strip 100, to the mull cap 102. The water exits the system 20 through the mull cap 102, for example, through the openings 166*a*, 166*b*.

The mull strip 100 attaches between the window frame members 5*c* and 5*d*. The cap 102 fits over the mull strip 100 at its bottom (as shown) as well as its top (for example, as shown in FIGS. 1B and 11, with the description below applicable to the caps 102 at this top of the mull strip 100). The protrusion 158 extends into the slot 5*cd*, and wall segment 156*x* frictionally contacts the fins 9, and the protrusion 159 is in frictional contact with the mull strip 100, along an inner surface 110*x*.

Water flows downward in the direction of the arrow 170, through the mull strip 100 to the cap 102. Once at the cap 102, the water flows out of the openings 166*a*, 166*b*, to the ambient environment. The flow may be directed by the main vein 162, as well as the stub members 164*a*, 164*b*.

FIGS. 21A and 21B show the cap 102 mounted on a mull strip 101 and the mounting of the cap 102/mullstrip 101 as a horizontal member in window frame members 5*a*' and 5*c*', with a slot 5*ac* between the corresponding fins 9 of the respective window frames 5*a*, 5*c* (FIG. 21A). These figures also show a pathway for the water through the mull strip 101, to the mull cap 102 and exiting the mull cap 102, for example, through the opening 166*b*.

The mull strip 101 attaches between the window frame members 5*a*' and 5*c*' (and also window frame members 5*b*' and 5*d*'), as shown in FIG. 15, and as described above. The cap 102 fits over the mull strip 101 at its side, with the protrusion 158 extending into the slot 5*ac* between the fins 9, the members 164*a*, 164*b* frictionally engaging the respective tabs 146, 147, and the wall segment 156*x* frictionally contacts the fins 9. The protrusion 159 is in frictional contact with the mull strip 101, along an inner surface 130*x*.

A drainage path for water, for example, in the form of condensate, is also shown in FIGS. 21A and 21B. Initially, water (moisture) falls from the window frame 5*a*' onto the upper lateral member 134 (as indicated by the arrows 174). As the member 134 is angled slightly downward, the water now flows toward the mull cap 102, as indicated by the arrows 176. Once in the mull cap 102, the veins 160*a*, 162, 160*b* facilitate movement (weeping) of the water to the opening 166*b*, in accordance with the arrows 178. The water exits (weeps from) the cap 102 through the opening 166*b* as shown by the arrow 179.

While preferred embodiments have been described, so as to enable one of skill in the art to practice the disclosed subject matter, the preceding description is intended to be exemplary only. It should not be used to limit the scope of the disclosed subject matter, which should be determined by reference to the following claims.

We claim:

1. A mullion system providing improved structural rigidity comprising:

a) a first component for being fastened to a frame of a first window unit, the first component having a distal end;

b) a second component for being fastened to a frame of a second window unit, the second component having a distal end;

c) a removably attachable unibody reinforcement key configured for joining the first component to the second component, wherein the unibody reinforcement key comprises a U-shaped member with a cross bar portion and oppositely disposed arms extending from the cross bar portion, the cross bar portion extending beyond the distal ends of the first component and the second component and configured for receipt in a securement member, the oppositely disposed arms extending into the distal ends of the first and second components; and d) a gusset plate for attachment to the distal ends of the first and second components, the gusset plate further comprising at least one aperture therein for receiving the cross bar portion of the unibody reinforcement key, the gusset plate defining the securement member.

2. The system of claim 1, wherein the first component and the second component include a groove extending substantially along the outer side of each of the first and second components intermediate the longitudinal ends of both components, the groove configured to receive the oppositely disposed arms of the unibody reinforcement key.

3. The system of claim 1, wherein the first component and the second component include a groove extending substantially along the outer side of each of the first and second components intermediate the longitudinal ends of both components, the groove configured to receive the cross bar portion of the unibody reinforcement key.

4. The system of claim 1, wherein the first component and the second component include inner sides, and correspondingly configured members for interlocking with each other extending from the inner sides of each of the components.

5. A mullion system providing improved structural rigidity comprising:

a) a first component for being fastened to a frame of a first window unit, the first component having a distal end;

b) a second component for being fastened to a frame of a second window unit, the second component having a distal end;

c) a removably attachable unibody reinforcement key configured for joining the first component to the second component, wherein the unibody reinforcement key comprises a U-shaped member with a cross bar portion and oppositely disposed arms extending from the cross bar portion, the cross bar portion extending beyond the distal ends of the first component and the second component and configured for receipt in a securement member, the oppositely disposed arms extending into the distal ends of the first and second components; and d) a gusset plate for attachment to the first and second window units, the gusset plate further comprising at least one aperture therein for receiving the cross bar portion of the unibody reinforcement key, the gusset plate defining the securement member.

6. The system of claim 5, wherein the first component and the second component include a groove extending substantially along the outer side of each of the first and second components intermediate the longitudinal ends of both components, the groove configured to receive the oppositely disposed arms of the unibody reinforcement key.

7. The system of claim 5, wherein the first component and the second component include a groove extending substantially along the outer side of each of the first and second components intermediate the longitudinal ends of both components, the groove configured to receive the cross bar portion of the unibody reinforcement key.

8. The system of claim 5, wherein the first component and the second component include inner sides, and correspondingly configured members for interlocking with each other extending from the inner sides of each of the components.

* * * * *